US010207312B2

(12) United States Patent
Oppenheimer et al.

(10) Patent No.: US 10,207,312 B2
(45) **Date of Patent: *Feb. 19, 2019**

(54) LUBRICATION PROCESSES FOR ENHANCED FORGEABILITY

(75) Inventors: Scott Oppenheimer, Charlotte, NC (US); Robin M. Forbes Jones, Charlotte, NC (US); John Mantione, Indian Trail, NC (US); Ramesh Minisandram, Charlotte, NC (US); Jean-Philippe Thomas, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 146 days.

This patent is subject to a terminal disclaimer.

(21) Appl. No.: 12/814,591

(22) Filed: Jun. 14, 2010

(65) Prior Publication Data

US 2011/0302978 A1 Dec. 15, 2011

(51) Int. Cl.

| | |
|---|---|
| ***B21J 3/00*** | (2006.01) |
| ***B21C 23/32*** | (2006.01) |
| ***C10M 103/02*** | (2006.01) |
| ***C10M 103/06*** | (2006.01) |
| *B21D 37/18* | (2006.01) |

(Continued)

(52) U.S. Cl.

CPC ..... *B21J 3/00* (2013.01); *B21C 23/32* (2013.01); *C10M 103/02* (2013.01); *C10M 103/06* (2013.01); *B21D 37/16* (2013.01); *B21D 37/18* (2013.01); *B21J 1/06* (2013.01); *C10M 2201/041* (2013.01); *C10M 2201/0413* (2013.01); *C10M 2201/0613* (2013.01); *C10M 2201/0653* (2013.01); *C10M 2201/0663* (2013.01); *C10N 2210/04* (2013.01); *C10N 2230/06* (2013.01); *C10N 2240/402* (2013.01);

(Continued)

(58) Field of Classification Search

CPC .. B21D 37/16; B21D 37/18; B21J 1/06; B21J 3/00

USPC ..... 72/39, 41, 42, 46, 47, 352, 353.2, 354.2, 72/354.6, 355.2, 355.6, 356; 29/424

See application file for complete search history.

(56) References Cited

U.S. PATENT DOCUMENTS

| | | | |
|---|---|---|---|
| 899,827 | A | 9/1908 | Cutter |
| 2,191,478 | A | 2/1940 | Hopkins |

(Continued)

FOREIGN PATENT DOCUMENTS

| | | | |
|---|---|---|---|
| CN | 85103156 | A | 3/1986 |
| CN | 101195871 | A | 6/2008 |

(Continued)

OTHER PUBLICATIONS

Machine Design, p. 41, "A new Nickle superalloy", by Hayes Intenational Inc., published by Penton Publishign, Mar. 2006.*

(Continued)

*Primary Examiner* — Sunil K Singh
*Assistant Examiner* — Chwen-Wei Su
(74) *Attorney, Agent, or Firm* — K&L Gates LLP; Robert J. Toth

(57) ABSTRACT

Forge lubrication processes are disclosed. A solid lubricant sheet is placed between a workpiece and a die in a forging apparatus. Force is applied to the workpiece with the die to plastically deform the workpiece. The solid lubricant sheet decreases the shear factor for the forging system and reduces the incidence of die-locking.

20 Claims, 15 Drawing Sheets

(51) Int. Cl.
*B21J 1/06* (2006.01)
*B21D 37/16* (2006.01)

(52) U.S. Cl.
CPC .... *C10N 2240/406* (2013.01); *C10N 2250/08* (2013.01)

(56) References Cited

U.S. PATENT DOCUMENTS 2,295,702 A 9/1942 Wissler
2,630,220 A 3/1953 Sejournet
2,653,026 A 9/1953 Feltus
2,706,850 A 4/1955 Sejournet et al.
2,893,555 A 7/1959 Buffet et al.
3,001,059 A 9/1961 Jones
3,021,594 A * 2/1962 Clatot et al. ..... 29/424
3,067,473 A 12/1962 Hopkins
3,105,048 A * 9/1963 Bobrowsky ..... C10M 5/00 508/108
3,122,828 A 3/1964 Havel
3,127,015 A 3/1964 Schieren
3,181,324 A 5/1965 Labino
3,339,271 A 9/1967 Durfee et al.
3,390,079 A 6/1968 Utakoji et al.
3,423,975 A 1/1969 Collinet
3,431,597 A 3/1969 Nowak et al.
3,446,606 A 5/1969 Friedrich et al.
3,493,713 A 2/1970 Johnson
3,566,661 A 3/1971 McCafferty et al.
3,617,685 A 11/1971 Brill-Edwards et al.
3,690,135 A 9/1972 Gagin et al.
3,693,419 A * 9/1972 De Pierre et al. ..... 73/790
3,752,216 A 8/1973 Fritsche
3,814,212 A * 6/1974 Latos ..... 184/109
3,863,325 A * 2/1975 Gurganus et al. ..... 29/423
3,869,393 A * 3/1975 Booker ..... 508/167
3,945,240 A * 3/1976 Brown ..... B21D 37/01 249/134
3,959,543 A 5/1976 Ellis
3,979,815 A 9/1976 Nakanose et al.
3,992,202 A 11/1976 Dulis et al.
4,055,975 A 11/1977 Serfozo et al.
4,060,250 A 11/1977 Davis et al.
4,160,048 A 7/1979 Jaeger
4,217,318 A * 8/1980 Anderson ..... 264/1.23
4,226,758 A 10/1980 Sumira
4,257,812 A 3/1981 Johnson et al.
4,544,523 A 10/1985 McCollough et al.
4,728,448 A 3/1988 Sliney
4,744,504 A 5/1988 Turner
4,780,484 A 10/1988 Schubert et al.
4,843,856 A * 7/1989 Bhowal et al. ..... 72/41
4,935,198 A 6/1990 Tornberg
4,943,452 A 7/1990 Itagaki et al.
4,961,991 A 10/1990 Howard
5,052,464 A 10/1991 Natori
5,141,566 A 8/1992 Kitayama et al.
5,259,965 A * 11/1993 Kishi et al. ..... 508/108
5,263,349 A 11/1993 Felix et al.
5,298,095 A 3/1994 Russo et al.
5,302,414 A 4/1994 Alkhimov et al.
5,348,446 A 9/1994 Lee et al.
5,374,323 A 12/1994 Kuhlman et al.
5,525,779 A 6/1996 Santella et al.
5,665,180 A 9/1997 Seetharaman et al.
5,743,120 A 4/1998 Balliett
5,743,121 A * 4/1998 Miller ..... 72/42
5,783,530 A * 7/1998 Foster ..... 508/505
5,788,142 A 8/1998 Bigay et al.
5,799,717 A 9/1998 Aoshima et al.
5,902,762 A * 5/1999 Mercuri et al. ..... 501/99
5,908,670 A 6/1999 Dunkerley et al.
5,951,792 A 9/1999 Balbach
5,981,081 A 11/1999 Sue
5,989,487 A 11/1999 Yoo et al.
6,006,564 A * 12/1999 Frisby et al. ..... 72/41
6,120,624 A 9/2000 Vogt et al.
6,154,959 A 12/2000 Goodwater et al.
6,202,277 B1 3/2001 Zahedi et al.
6,269,669 B1 8/2001 Matsubara et al.
6,296,043 B1 10/2001 Bowen et al.
6,309,591 B1 10/2001 Yoo et al.
6,312,022 B1 11/2001 Brophy, III et al.
6,329,079 B1 12/2001 Meyer
6,330,818 B1 12/2001 Jain
6,418,795 B2 7/2002 Im et al.
6,484,790 B1 11/2002 Myers et al.
6,547,952 B1 4/2003 Staerzl
6,623,690 B1 9/2003 Rizzo et al.
6,753,504 B2 6/2004 Keller et al.
6,773,824 B2 8/2004 Rizzo et al.
6,774,346 B2 * 8/2004 Clothier ..... 219/620
6,865,917 B2 3/2005 Golovashchenko et al.
6,933,045 B2 8/2005 Tamura
6,933,058 B2 8/2005 Darolia et al.
7,000,306 B2 2/2006 Rice et al.
7,108,483 B2 9/2006 Segletes et al.
7,114,548 B2 10/2006 Forbes Jones
7,172,820 B2 2/2007 Darolia et al.
7,178,376 B2 2/2007 Bergue et al.
7,188,498 B2 3/2007 Browne et al.
7,208,116 B2 4/2007 Manning et al.
7,257,981 B2 8/2007 Natsui et al.
7,264,888 B2 9/2007 Darolia et al.
7,288,328 B2 10/2007 Darolia et al.
7,316,057 B2 1/2008 Seth
7,357,958 B2 4/2008 Darolia et al.
7,445,434 B2 11/2008 Harada et al.
7,516,526 B2 4/2009 Rice et al.
7,618,684 B2 11/2009 Nesbitt
7,722,330 B2 5/2010 Seth
7,770,427 B2 8/2010 Nakahara et al.
7,803,212 B2 9/2010 Forbes Jones et al.
7,927,085 B2 4/2011 Hall et al.
8,002,166 B2 8/2011 Nielsen et al.
8,230,899 B2 7/2012 Minisandram
8,303,289 B2 11/2012 Goller et al.
8,327,676 B2 12/2012 Nishimori et al.
8,327,681 B2 12/2012 Davidson et al.
8,376,726 B2 2/2013 Goller et al.
8,545,994 B2 10/2013 Facchini et al.
2001/0027686 A1 * 10/2001 Im ..... G01N 3/24 73/841
2002/0005233 A1 1/2002 Schirra et al.
2002/0019321 A1 2/2002 Balliett et al.
2004/0079453 A1 4/2004 Groh et al.
2004/0105774 A1 6/2004 Del Corso et al.
2005/0044800 A1 3/2005 Hall et al.
2005/0273994 A1 12/2005 Bergstrom et al.
2006/0239852 A1 10/2006 Shipton et al.
2010/0083728 A1 * 4/2010 Morales ..... 72/412
2010/0236317 A1 * 9/2010 Sigelko ..... B21D 37/16 72/356
2011/0171490 A1 7/2011 Demirci et al.
2011/0195270 A1 8/2011 De Souza et al.
2011/0302979 A1 12/2011 Oppenheimer et al.
2012/0183708 A1 7/2012 Minisandram
2012/0279678 A1 11/2012 Minisandram
2013/0142686 A1 6/2013 Lipetzky
2014/0246165 A1 9/2014 Minisandram
2014/0260478 A1 9/2014 Forbes Jones et al.
2014/0271337 A1 9/2014 Banik et al.
2014/0290321 A1 10/2014 Minisandram
2016/0167100 A1 6/2016 De Souza et al.
2017/0050234 A1 2/2017 Banik et al.

FOREIGN PATENT DOCUMENTS

CN 101412066 A 4/2009
CN 101517112 A 8/2009
CN 101554491 A 10/2009
EP 0128682 A1 12/1984
EP 386515 2/1990
EP 0767028 4/1997
EP 0969114 1/2000

(56) References Cited

FOREIGN PATENT DOCUMENTS

| | | | |
|---|---|---|---|
| EP | 1197570 | | 4/2002 |
| EP | 2286942 | A1 | 2/2011 |
| GB | 684013 | A | 12/1952 |
| GB | 1202080 | A | 8/1970 |
| GB | 1207675 | A | 10/1970 |
| GB | 1472939 | | 5/1977 |
| GB | 2190319 | A | 11/1987 |
| GB | 2262540 | A | 6/1993 |
| JP | 52-114524 | A | 9/1977 |
| JP | S52-147556 | | 12/1977 |
| JP | 53-108842 | A | 9/1978 |
| JP | 54-52656 | A | 4/1979 |
| JP | S54-29418 | B2 | 9/1979 |
| JP | S55-122661 | A | 9/1980 |
| JP | 56-109128 | A | 8/1981 |
| JP | S57-112923 | A | 7/1982 |
| JP | S57-209736 | A | 12/1982 |
| JP | S59-6724 | B2 | 2/1984 |
| JP | 59-179214 | A | 10/1984 |
| JP | S59-227992 | A | 12/1984 |
| JP | S60-47012 | B2 | 10/1985 |
| JP | S60-215557 | A | 10/1985 |
| JP | S61-148407 | U | 9/1986 |
| JP | 61-255757 | A | 11/1986 |
| JP | 61-269929 | A | 11/1986 |
| JP | S64-28382 | A | 1/1989 |
| JP | 1-271021 | | 10/1989 |
| JP | H01-274319 | | 11/1989 |
| JP | H02-104435 | A | 4/1990 |
| JP | H02-107795 | A | 4/1990 |
| JP | H03-90212 | A | 4/1991 |
| JP | H03-174938 | A | 7/1991 |
| JP | H03-277751 | A | 12/1991 |
| JP | H03-297533 | A | 12/1991 |
| JP | H04-13434 | A | 1/1992 |
| JP | H04-66607 | | 3/1992 |
| JP | 4-118133 | A | 4/1992 |
| JP | H05-4994 | A | 1/1993 |
| JP | H05-147975 | A | 6/1993 |
| JP | 6-63743 | A | 3/1994 |
| JP | H06-63638 | A | 3/1994 |
| JP | H06-106232 | A | 4/1994 |
| JP | H06-154842 | A | 6/1994 |
| JP | H06-277748 | A | 10/1994 |
| JP | H06-328125 | A | 11/1994 |
| JP | H07-11403 | A | 1/1995 |
| JP | H07-223018 | A | 8/1995 |
| JP | H09-271981 | A | 10/1997 |
| JP | 11-10222 | A | 1/1999 |
| JP | 11-320073 | | 11/1999 |
| JP | 2000-288674 | A | 10/2000 |
| JP | 2000-312905 | A | 11/2000 |
| JP | 2003-239025 | A | 8/2003 |
| JP | 2003-260535 | A | 9/2003 |
| JP | 2004-67426 | A | 3/2004 |
| JP | 2005-40810 | A | 2/2005 |
| JP | 2009-66661 | A | 4/2009 |
| JP | 2010-519 | A | 1/2010 |
| JP | 2010-65135 | A | 3/2010 |
| JP | 2013-119100 | A | 6/2013 |
| RU | 2020020 | C1 | 9/1994 |
| RU | 2070461 | C1 | 12/1996 |
| RU | 2133652 | C1 | 7/1999 |
| RU | 2145981 | C1 | 2/2000 |
| RU | 2145982 | C1 | 2/2000 |
| RU | 2275997 | C2 | 5/2006 |
| RU | 2337158 | C2 | 10/2008 |
| RU | 2355791 | C2 | 5/2009 |
| RU | 2415967 | C2 | 4/2011 |
| SU | 435288 | A1 | 7/1974 |
| SU | 1015951 | A1 | 5/1983 |
| SU | 1076162 | A1 | 2/1984 |
| SU | 1299985 | A1 | 3/1987 |
| SU | 1540977 | A1 | 2/1990 |
| SU | 1606252 | A1 | 11/1990 |
| SU | 1761364 | A1 | 9/1992 |
| TW | 562714 | B | 11/2003 |
| WO | WO 92/07050 | A1 | 4/1992 |
| WO | WO 94/13849 | A1 | 6/1994 |
| WO | WO 1995/35396 | | 12/1995 |
| WO | WO 98/05463 | A1 | 2/1998 |
| WO | WO-99/02743 | A1 | 1/1999 |
| WO | WO 2001/012381 | | 2/2001 |
| WO | WO 02/27067 | A1 | 4/2002 |
| WO | WO 2007/098439 | A1 | 8/2007 |

OTHER PUBLICATIONS

Atlan et al., *Metal Forming: Fundamentals and Applications*, Ch. 6.

Friction in Metal Forming, ASM: 1993.

U.S. Appl. No. 13/833,043, filed Mar. 15, 2013.

U.S. Appl. No. 14/278,134, filed May 15, 2014.

Donachie et al., Superalloys: A Technical Guide, Melting and Conversion, pp. 56-77, ASM International, 2002.

Paton et al., ESS LM as a way for heavy ingot manufacturing, LMPC, 2007.

ASTM E2465—06 (2006): Standard Test Method for Analysis of Ni-Base Alloys by X-ray Fluorescence Spectrometry.

ASTM E1019—08 (2008): Standard Test Methods for Determination of Carbon, Sulfur, Nitrogen, and Oxygen in Steel, Iron, Nickel, and Cobalt Alloys by Various Combustion and Fusion Techniques.

Santella, An overview of the welding of Ni3AI and Fe3AI alloys, ASME and ASM Materials Conference, Dec. 31, 1996.

Levinet al., Robotic weld overlay coatings for erosion control, Quarterly Technical progress Report for U.S. DOE Grant No. DE-FG22-92PS92542, Lehigh University, Energy Research Center, Apr. 25, 1995.

Maziasz et al., Overview of the development of FeAI intermetallic alloys, Proceedings of the 2d International Conference on Heat-Resistant Materials, Sep. 1, 1995.

Ito et al., Blast erosion properties of overlay weld metal, Welding International, 5:3, 1991, pp. 192-197.

Horn et al., Auftragschweißungen mit Hastelloy alloy B-42 (Overlay welding with Hastelloy B-42), Materials and Corrosion, 43:8, 1992, pp. 381-387.

Tillack, Weld fabrication of nickel-containing materials, Practical handbook of stainless steels & nickel alloys, Lamb ed., CASTI Publishing Inc., ASM International, Aug. 1999, pp. 325-370.

Insulating Method Improves Superalloy Forging, Baosteel Technical Research, Apr. 23, 2012, vol. 5, No. 4, 2 pages.

ITC-100, ITC-200, ITC-213 Ceramic Coatings, BCS International Technical Ceramics Coatings, http://budgetcastingsupply.com/ITC.php, Feb. 2013, 3 pages.

ITC-100 Base Coat, ITC-296A Top Coat, Coatings, http://budgetcastingsupply.com/ITC-Wool, 2013.

Carbon Steel, E-Z LOK, AISI 12L14 Steel, cold drawn, 19-38 mm round, Aug. 5, 2013, http://www.ezlok.com/TechnicalInfo/MPCarbonSteel.html, 1 page.

Alloy 309/309S, Specification Sheet: Alloy 309, Sandmeyer Steel Company, Aug. 5, 2013, http://www.sandmeyersteel.com/309-309S.html, 4 pages.

Shivpuri, R. and S. Kini, Lubricants and Their Applications in Forging, ASM Handbook, vol. 14A, Metalworking: Bulk Forming, Semiatin, S.L., ed., 2005, ASM International, Ohio, US, p. 84.

Schey et al., Laboratory Testing of Glass Lubricants, Lubrication Engineering/Tribology and Lubrication Technology, Society of Tribologists and Lubrication Engineers, US, vol. 30, No. 10, Oct. 1, 1974, pp. 489-497.

McGraw Hill Encyclopedia of Science and Technology, 1992, McGraw Hill Inc., vol. 11, pp. 32-33.

Chesney, Peter, A New Spray Coating Process for Manufacture of Stainless Steel Clad Construction Steel with Resistance to Corrosion by De-icing Salts & Seawater, Spray Forming International, Cayce, South Carolina, USA, Thermal Spray 2003: Advancing the Science and Applying the Technology, ASM International, 2003, 5 pages.

Anchor Industrial Sales, Inc. Product Data Sheets, Style #412 Fiberglass cloth, Style #412IB Fiberglass Mats, 2008, 2 pages.

(56) References Cited

OTHER PUBLICATIONS

Belfort, M.G. and V.E. Patton, "Equipment for arc and slag welding and weld deposition", Moscow, High School, 1974.
Crucible Compaction Metals P/M Low Carbon Astroloy, Supersolvus, printed from http://www/matweb.com/search/datasheet_print.aspx?matguid=e1bac255c1964e19a43b29 . . . on Aug. 17, 2011, 2 pages.
Gayda, John, "NASA/TM-2001-210814 High Temperature Fatigue Crack Growth Behavior of Alloy 10", Glenn Research Center, Cleveland, Ohio, National Aeronautics and Space Administration, Apr. 2001, 7 pages.
Advanced Solutions for Higher Performance and Longer Life, ATI Powder Metals Applications, printed from http://www.alleghenytechnologies.com/atipowder/applications/default.asp on Sep. 22, 2011, 4 pages.
Wlodek et al., "The Structure of Rene 88 DT", Superalloys 1996, Eds. Kissinger et al., The Minerals, Metals & Materials Society, 1996, pp. 129-136.
Zielinska et al., "Thermal properties of cast nickel based superalloys", Archives of Materials Science and Engineering, vol. 44, Issue 1, Jul. 2010, pp. 35-38.
Charpy V-Notch Impact Testing, History and Process, Laboratory Testing, Inc., 2 pages.
Rockwell Hardness Testing, Materials Evaluation and Engineering, Inc., 2009, 2 pages.
Steel Handbook, 3rd Edition, Bar Steel/Steel Tube/Rolling Common Equipment, Edited by Iron and Steel Inst. of Japan, Jun. 27, 2010.
U.S. Appl. No. 15/143,693, filed May 2, 2016.
Steel Enchiridion, The Iron and Steel Institute of Japan (ISIJ), Japan, Maruzen Co. Ltd., Nov. 20, 1980, 3rd Edition, vol. 3 (2), pp. 1013-1037.
The Iron and Steel Institute of Japan (ISIJ), Steel Enchiridion, Maruzen Co., Ltd., 3rd edition, vol. 111(2), Nov. 20, 1980.
High Temperature Glass Forging Lubricants for Super and Titanium Alloys, Advanced Technical Products Supply Co., Inc., Cincinnati, Ohio, page as available on Internet on Oct. 2017, accessed on web.archive.org, 2 pages.
Advanced Technical Products Supply Co., Inc., Cincinnati, Ohio, page as available on Internet on Oct. 2017, accessed on web.archive.org, 1 page.

* cited by examiner

LUBRICATION PROCESSES FOR ENHANCED FORGEABILITY

STATEMENT REGARDING FEDERALLY SPONSORED RESEARCH AND DEVELOPMENT

This invention was made with United States government support under Advanced Technology Program Award No. 70NANB7H7038, awarded by the National Institute of Standards and Technology (NIST), United States Department of Commerce. The United States government may have certain rights in the invention.

TECHNICAL FIELD

This disclosure is directed to processes for decreasing friction between dies and workpieces during forging operations and increasing the forgeability of workpieces, such as, for example, metal and alloy ingots and billets.

BACKGROUND

"Forging" refers to the working and/or shaping of a solid-state material by plastic deformation. Forging is distinguishable from the other primary classifications of solid-state material forming operations, i.e., machining (shaping of a workpiece by cutting, grinding, or otherwise removing material from the workpiece) and casting (molding liquid material that solidifies to retain the shape of a mold). Forgeability is the relative capacity of a material to plastically deform without failure. Forgeability depends on a number of factors including, for example, forging conditions (e.g., workpiece temperature, die temperature, and deformation rate) and material characteristics (e.g., composition, microstructure, and surface structure). Another factor that affects the forgeability of a given workpiece is the tribology of the interacting die surfaces and workpiece surfaces.

The interaction between die surfaces and workpiece surfaces in a forging operation involves heat transfer, friction, and wear. As such, insulation and lubrication between a workpiece and forging dies are factors influencing forgeability. In forging operations, friction is decreased by the use of lubricants. However, prior forging lubricants have various deficiencies, particularly in the context of hot forging titanium alloys and superalloys. The present disclosure is directed to lubrication processes for decreasing the friction between dies and workpieces during forging operations that overcome various deficiencies of prior forge lubrication methods.

SUMMARY

Embodiments disclosed herein are directed to forge lubrication processes comprising positioning a solid lubricant sheet between a workpiece and a die in a forging apparatus. The die applies force to the workpiece to plastically deform the workpiece. The shear factor between the die and the workpiece during forging is less than 0.20.

Other embodiments disclosed herein are directed to forge lubrication processes comprising positioning a solid graphite sheet between a titanium or titanium alloy workpiece and a die in a forging apparatus. The die applies force to the workpiece to plastically deform the workpiece at a temperature in the range of 1000° F. to 2000° F. The shear factor between the die and the workpiece during forging is less than 0.20.

It is understood that the invention disclosed and described herein is not limited to the embodiments disclosed in this Summary.

BRIEF DESCRIPTION OF THE DRAWINGS

Various characteristics of certain non-limiting embodiments disclosed and described herein may be better understood by reference to the accompanying figures, in which.

Figure 1B:
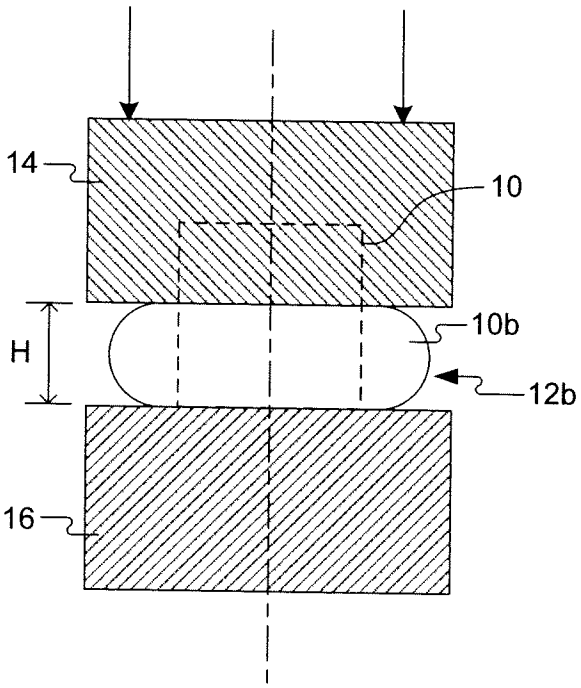
FIG. 1B is a cross-sectional schematic diagram illustrating the open-die upset forging of an identical workpiece under high friction conditions.

The reader will appreciate the foregoing details, as well as others, upon considering the following detailed description of various non-limiting embodiments according to the present disclosure. The reader may also comprehend additional details upon implementing or using embodiments described herein.

DETAILED DESCRIPTION OF NON-LIMITING EMBODIMENTS

It is to be understood that the descriptions of the disclosed embodiments have been simplified to illustrate only those features and characteristics that are relevant to a clear understanding of the disclosed embodiments, while eliminating, for purposes of clarity, other features and characteristics. Persons having ordinary skill in the art, upon considering this description of the disclosed embodiments, will recognize that other features and characteristics may be desirable in a particular implementation or application of the disclosed embodiments. However, because such other features and characteristics may be readily ascertained and implemented by persons having ordinary skill in the art upon considering this description of the disclosed embodiments, and are, therefore, not necessary for a complete understanding of the disclosed embodiments, a description of such features, characteristics, and the like, is not provided herein. As such, it is to be understood that the description set forth herein is merely exemplary and illustrative of the disclosed embodiments and is not intended to limit the scope of the invention defined by the claims.

In the present disclosure, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. § 112, first paragraph, and 35 U.S.C. § 132(a).

The grammatical articles "one", "a", "an", and "the", as used herein, are intended to include "at least one" or "one or more", unless otherwise indicated. Thus, the articles are used herein to refer to one or more than one (i.e., to "at least one") of the grammatical objects of the article. By way of example, "a component" means one or more components, and thus, possibly, more than one component is contemplated and may be employed or used in an implementation of the described embodiments.

Any patent, publication, or other disclosure material that is said to be incorporated by reference herein, is incorporated herein in its entirety unless otherwise indicated, but only to the extent that the incorporated material does not conflict with existing definitions, statements, or other disclosure material expressly set forth in this description. As such, and to the extent necessary, the express disclosure as set forth herein supersedes any conflicting material incorporated by reference herein. Any material, or portion thereof, that is said to be incorporated by reference herein, but which conflicts with existing definitions, statements, or other disclosure material set forth herein is only incorporated to the extent that no conflict arises between that incorporated material and the existing disclosure material. Applicant reserves the right to amend the present disclosure to expressly recite any subject matter, or portion thereof, incorporated by reference herein.

The present disclosure includes descriptions of various embodiments. It is to be understood that the various embodiments described herein are exemplary, illustrative, and non-limiting. Thus, the present disclosure is not limited by the description of the various exemplary, illustrative, and non-limiting embodiments. Rather, the invention is defined by the claims, which may be amended to recite any features or characteristics expressly or inherently described in or otherwise expressly or inherently supported by the present disclosure. Further, Applicants reserve the right to amend the claims to affirmatively disclaim features or characteristics that may be present in the prior art. Therefore, any such amendments would comply with the requirements of 35 U.S.C. § 112, first paragraph, and 35 U.S.C. § 132(a). The various embodiments disclosed and described herein can comprise, consist of, or consist essentially of the features and characteristics as variously described herein.

In forging operations, the interface friction between workpiece surfaces and die surfaces may be quantitatively expressed as the frictional shear stress. The frictional shear stress ($\tau$) may be expressed as a function of the solid flow stress of the deforming material ($\sigma$) and the shear factor (m) by the following equation:

$$\tau = \frac{m}{\sqrt{3}}\bar{\sigma}$$

The value of the shear factor provides a quantitative measure of lubricity for a forging system. For example, the shear factor may range from 0.6 to 1.0 when forging titanium alloy workpieces without lubricants, whereas the shear factor may range from 0.1 to 0.3 when hot forging titanium alloy workpieces with certain molten lubricants.

Figure 1A:
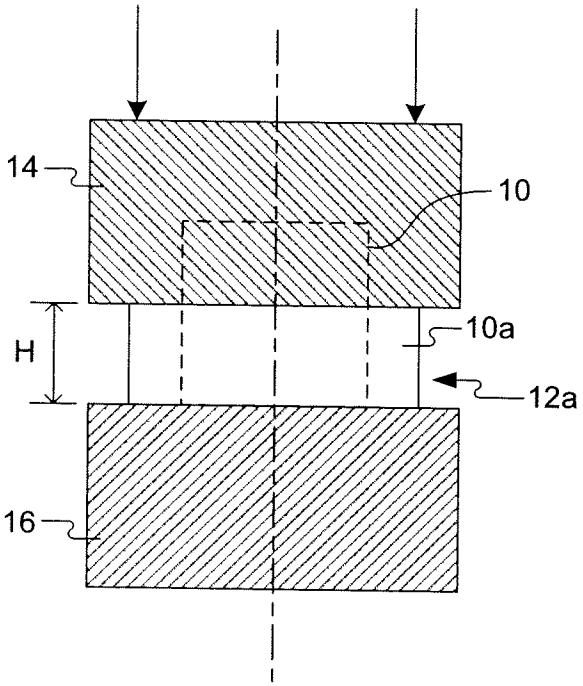
FIG. 1A is a cross-sectional schematic diagram illustrating the open-die upset forging of a workpiece under frictionless conditions.

Inadequate forging lubrication, characterized, for example, by a relatively high value of the shear factor for a forging operation, may have a number of adverse effects. In forging, the solid-state flow of material is caused by the force transmitted from the dies to the plastically deforming workpiece. The frictional conditions at the die/workpiece interface influence metal flow, formation of surface and internal stresses within the workpiece, stresses acting on the dies, and pressing load and energy requirements. FIGS. 1A and 1B illustrate certain frictional effects in connection with an open-die upset forging operation.

FIG. 1A illustrates the open-die upset forging of a cylindrical workpiece 10 under theoretical frictionless conditions. FIG. 1B illustrates the open-die upset forging of an identical cylindrical workpiece 10 under high friction conditions. The upper dies 14 press the workpieces 10 from their initial height (shown by dashed lines) to a forged height H. The upsetting force is applied with equal magnitude and in opposite direction to the workpieces 10 by the upper dies 14 and the lower dies 16. The material forming the workpieces 10 is incompressible and, therefore, the volumes of the initial workpieces 10 and the forged workpieces 10*a* and 10*b* are equal. Under the frictionless conditions illustrated in FIG. 1A, the workpiece 10 deforms uniformly in the axial and radial directions. This is indicated by the linear profile 12*a* of the forged workpiece 10*a*. Under the high friction conditions illustrated in FIG. 1B, the workpiece 10 does not deform uniformly in the axial and radial directions. This is indicated by the curved profile 12*b* of the forged workpiece 10*b*.

In this manner, the forged workpiece 10*b* exhibits "barreling" under high friction conditions, whereas the forged workpiece 10*a* does not exhibit any barreling under frictionless conditions. Barreling and other effects of non-uniform plastic deformation due to die/workpiece interface friction during forging are generally undesirable. For example, in closed-die forging, interface friction may cause the formation of void spaces where deforming material does not fill all the cavities in the die. This may be particularly problematic in net-shape or near-net-shape forging operations where workpieces are forged within tighter tolerances. As a result, forging lubricants may be employed to reduce interface friction between die surfaces and workpiece surfaces during forging operations.

In various embodiments, a forge lubrication process comprises positioning a solid lubricant sheet between a workpiece and a die in a forging apparatus. As used herein, a "solid lubricant sheet" is a relatively thin piece of material comprising a solid-state lubricant that reduces friction between metallic surfaces. The solid-state lubricant is in the solid state under ambient conditions and remains in the solid state under forging conditions (e.g., at elevated temperatures). The solid lubricant sheet may decrease the shear factor between a die and a workpiece during forging to less than 0.20. The solid lubricant sheet may comprise a solid-state lubricant material selected from the group consisting of graphite, molybdenum disulfide, tungsten disulfide, and boron nitride.

In various embodiments, a solid lubricant sheet may comprise a solid-state lubricant having a coefficient of friction less than or equal to 0.3 at room temperature and/or a melting point temperature greater than or equal to 1500° F. Solid-state lubricants finding utility in the solid lubricant sheets disclosed herein may also be characterized, for example, by a shear flow stress value of up to and including 20% of the shear flow stress value of a material being forged with a solid lubricant sheet comprising the solid-state lubricant. In various embodiments, a solid-state lubricant comprising a solid lubricant sheet may be characterized by a shear ductility of greater than or equal to 500%. Solid-state lubricants finding utility in the solid lubricant sheets disclosed herein possess the capability of being processed into sheet form, with or without suitable binder or bonding agent.

In various embodiments, the solid lubricant sheet may be flexible and capable of being positioned in cavities and over contours and non-planar surfaces of forging dies and/or workpieces. In various embodiments, the solid lubricant sheet may be rigid and maintain a pre-formed shape or contour while being positioned between a die and a workpiece in a forging apparatus.

In various embodiments, the solid lubricant sheet may consist of a solid-state lubricant compound (such as, for example, graphite, molybdenum disulfide, tungsten disulfide, and/or boron nitride) and residual impurities (such as, for example, ash), and contain no binders, fillers, or other additives. Alternatively, in various embodiments, the solid lubricant sheet may comprise solid-state lubricant and binders, fillers, and/or other additives. For example, the solid lubricant sheet may contain oxidation inhibitors that allow for continuous or repeated use at elevated temperatures in oxygen-containing environments, such as, for example, ambient air or high temperature air.

In various embodiments, the solid lubricant sheet may comprise a laminate of solid-state lubricant bonded to a fiber sheet. For example, solid-state lubricants may be adhesively-bonded or thermally-bonded to ceramic fiber sheets, glass fiber sheets, carbon fiber sheets, or polymeric fiber sheets. Suitable fiber sheets include woven and non-woven fiber sheets. The solid lubricant sheet may comprise a laminate of solid-state lubricant bonded to one side, or both sides, of a fiber sheet. Examples of laminates of a flexible graphite sheet bonded to a flexible fiber sheet, which may find utility as solid lubricant sheets in the processes disclosed herein, are described, for example, in U.S. Pat. No. 4,961,991, which is incorporated by reference herein.

In various embodiments, the solid lubricant sheet may comprise a laminate of solid-state lubricant bonded to a polymeric sheet. For example, solid-state lubricants may be adhesively-bonded or thermally-bonded to one side, or both sides, of a flexible polymer sheet. In various embodiments, the solid lubricant sheet may comprise an adhesive-backed sheet of solid-state lubricant. For example, a sheet of graphite, molybdenum disulfide, tungsten disulfide, and/or boron nitride may comprise an adhesive compound applied to one side of the sheet. An adhesive-backed solid lubricant sheet may be applied and adhered to die and/or workpiece surfaces before forging to ensure proper positioning of the solid lubricant sheet during the forging operation, for example. Solid lubricant sheets comprising polymeric materials, adhesives, and/or other organic materials may be used in hot forging operations where organic burn-out is acceptable.

In various embodiments, the solid lubricant sheet may have a thickness in the range 0.005" (0.13 mm) to 1.000" (25.4 mm), or any sub-range therein. For example, in various embodiments, the solid lubricant sheet may have a minimum, maximum, or average thickness of 0.005" (0.13 mm), 0.006" (0.15 mm), 0.010" (0.25 mm), 0.015" (0.38 mm), 0.020" (0.51 mm), 0.025" (0.64 mm), 0.030" (0.76 mm), 0.035" (0.89 mm), 0.040" (1.02 mm), 0.060" (1.52 mm), 0.062" (1.57 mm), 0.120" (3.05 mm), 0.122" (3.10 mm), 0.24" (6.10 mm), 0.5" (12.70 mm), or 0.75" (19.05 mm). The above thicknesses may be obtained with a single solid lubricant sheet or with a stack of multiple solid lubricant sheets.

The thickness of the solid lubricant sheet or stack of sheets used in a forging operation may depend on various factors including forge temperature, forge time, workpiece size, die size, forge pressure, extent of deformation of the workpiece, and the like. For example, the temperature of the workpiece and a die in a forging operation may affect lubricity of the solid lubricant sheet and heat transfer through the solid lubricant sheet. Thicker sheets or stacks of sheets may be useful at higher temperatures and/or longer forge times due to, for example, compression, caking, and/or oxidation of the solid-state lubricant. In various embodiments, the solid lubricant sheets disclosed herein may thin out over the surfaces of a workpiece and/or a die during a forging operation and, therefore, thicker sheets or stacks of sheets may be useful for increased deformation of the workpiece.

In various embodiments, the solid lubricant sheet may be a solid graphite sheet. The solid graphite sheet may have a graphitic carbon content of at least 95% by weight of the graphite sheet. For example, the solid graphite sheet may have a graphitic carbon content of at least 96%, 97%, 98%, 98.2%, 99.5%, or 99.8%, by weight of the graphite sheet. Solid graphite sheets suitable for the processes disclosed herein include, for example, the various grades of Grafoil® flexible graphite materials available from GrafTech International, Lakewood, Ohio, USA; the various grades of graphite foils, sheets, felts, and the like, available from HP Materials Solutions, Inc, Woodland Hills, Calif., USA; the various grades of Graph-Lock® graphite materials available from Garlock Sealing Technologies, Palmyra, N.Y., USA; the various grades of flexible graphite available from Thermoseal, Inc., Sidney, Ohio, USA; and the various grades of graphite sheet products available from DAR Industrial Products, Inc., West Conshohocken, Pa., USA.

In various embodiments, a solid lubricant sheet may be positioned on a working surface of a die in a forging apparatus and a workpiece positioned on the solid lubricant sheet on the die. As used herein, a "working surface" of a die is a surface that does, or may, contact a workpiece during a forging operation. For example, a solid lubricant sheet may be positioned on a lower die of a press forging apparatus and a workpiece is positioned on the solid lubricant sheet so that the solid lubricant sheet is in an interposed position between a bottom surface of the workpiece and the lower die. An additional solid lubricant sheet may be positioned onto a top surface of the workpiece before or after the workpiece is positioned on the solid lubricant sheet on the lower die. Alternatively, or in addition, a solid lubricant sheet may be positioned on an upper die in the forging apparatus. In this manner, at least one additional solid lubricant sheet may be interposed between a top surface of the workpiece and the upper die. Force may then be applied to the workpiece between the dies to plastically deform the workpiece with decreased friction between the dies and the workpiece, which decreases undesirable frictional effects.

In various embodiments, a solid lubricant sheet may be a flexible or rigid sheet that may be bent, formed, or contoured to match the shape of a die and/or the workpiece in a forging operation. The solid lubricant sheet may be bent, formed, or contoured before being positioned on a workpiece and/or a die in a forging apparatus, i.e., pre-formed into a predetermined shape or contour. For example, pre-formed shapes may include one or more folds in a solid lubricant sheet (e.g., an approximately 135° axial bend to aid in the placement of the sheet on the upper curved surface of a cylindrical workpiece along its longitudinal axis, or one or more approximately 90° bends to aid in the placement of the sheet on a rectangular workpiece). Alternatively, the solid lubricant sheet may be formed into a flexible or rigid sleeve, tube, hollow cylinder, or other geometry intended to locate and mechanically secure the solid lubricant sheet on a die or workpiece surface before forging.

When a solid lubricant sheet is interposed between a die and a workpiece in a forging apparatus, the solid lubricant sheet may provide a solid-state barrier between the die and the workpiece. In this manner, the die indirectly contacts the workpiece through the solid lubricant sheet, which reduces friction between the die and the workpiece. The solid-state lubricant of the solid lubricant sheet may be characterized by a relatively low shear flow stress value and a relatively high shear ductility value, which allows the solid lubricant sheet to flow along the die-workpiece interface as a continuous film during forging. For example, in various embodiments, solid-state lubricants finding utility in the solid lubricant sheets disclosed herein may be characterized, for example, by a shear ductility of greater than or equal to 500% and a shear flow stress value of up to and including 20% of the shear flow stress value of the material being forged with a solid lubricant sheet comprising the solid-state lubricant.

By way of example, graphite solid-state lubricant is composed of stacked graphene layers. The graphene layers are one-atom-thick layers of covalently-bonded carbon. The shear forces between graphene layers in graphite are very low and, therefore, the graphene layers can slide relative to each other with very little resistance. In this manner, graphite exhibits relatively low shear flow stress and relatively high shear ductility, which allows a graphite sheet to flow along a die-workpiece interface as a continuous film during forging. Hexagonal boron nitride, molybdenum disulfide, and tungsten disulfide have a similar crystalline lattice structures with very low shear forces between the crystalline lattice layers that minimize resistance between sliding surfaces and, therefore, exhibit analogous dry lubricity properties.

During a forging operation, as the solid lubricant sheet is compressed between a die and a workpiece and flows in shear to maintain lubricity, it may mechanically adhere to the surfaces of the die and workpiece as the solid lubricant sheet compacts at locations where forge pressure is applied. In various embodiments, any compacted or "caked" solid lubricant sheet may be retained on or removed from either the workpiece or the die before subsequent forging operations or other operations.

Figure 2A:
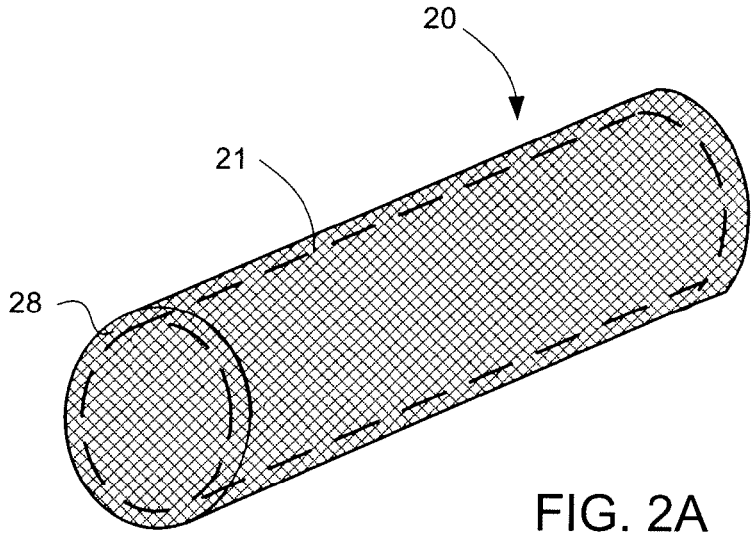
FIGS. 2A, 2B, and 2C are perspective views of a cylindrical workpiece wrapped in a solid lubricant sheet.
Figure 2B:
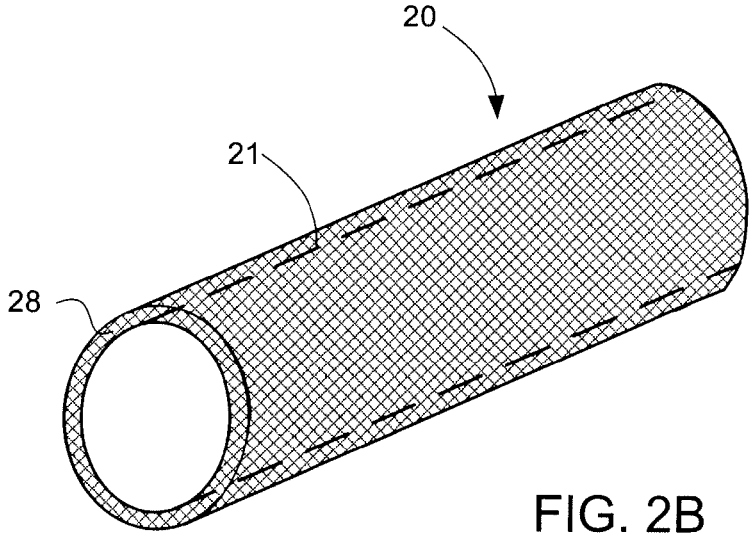
Figure 2C:
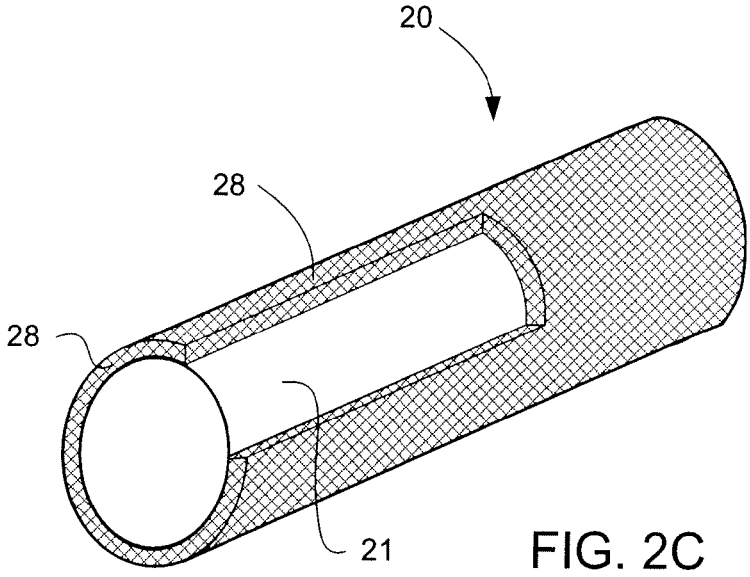

In various embodiments, a solid lubricant sheet may be positioned on a workpiece before the workpiece is positioned in a forging apparatus. For example, at least a portion of a surface of a workpiece may be wrapped with a solid lubricant sheet. FIGS. 2A through 2C illustrate a cylindrical workpiece 20 wrapped with a solid lubricant sheet 28 before forging. FIG. 2A shows all of the outer surfaces of the workpiece 20 covered by solid lubricant sheets 28. FIG. 2B shows only the circumferential surfaces of the workpiece 20 covered by a solid lubricant sheet 28. No solid lubricant sheet is positioned on the end surfaces of the workpiece 20 in FIG. 2B. FIG. 2C shows the workpiece 20 of FIG. 2B with a portion of the solid lubricant sheet 28 removed to see the underlying cylindrical surface 21 of workpiece 20.

In various embodiments, a solid lubricant sheet may be positioned on one or more of the dies in a forging apparatus before a workpiece is positioned in the forging apparatus. In various embodiments, adhesive-backed solid lubricant sheets are positioned on workpieces and/or dies before forging. Alternatively, solid lubricant sheets may be secured with a separate adhesive on workpieces and/or dies to better ensure proper positioning of the solid lubricant sheets during the forging operation. In embodiments where a forging operation comprises two or more strokes of the forging apparatus, additional solid lubricant sheets may be interposed between a die surface and a workpiece surface between any two strokes.

The forge lubrication processes disclosed herein may be applied to any forging operation wherein enhanced lubrication and forgeability would be advantageous. For example, and without limitation, the forge lubrication processes disclosed herein may be applied to open-die forging, closed-die forging, forward extrusion, backward extrusion, radial forging, upset forging, and draw forging. In addition, the forge lubrication processes disclosed herein may be applied to net-shape and near-net shape forging operations.

Figure 3B:
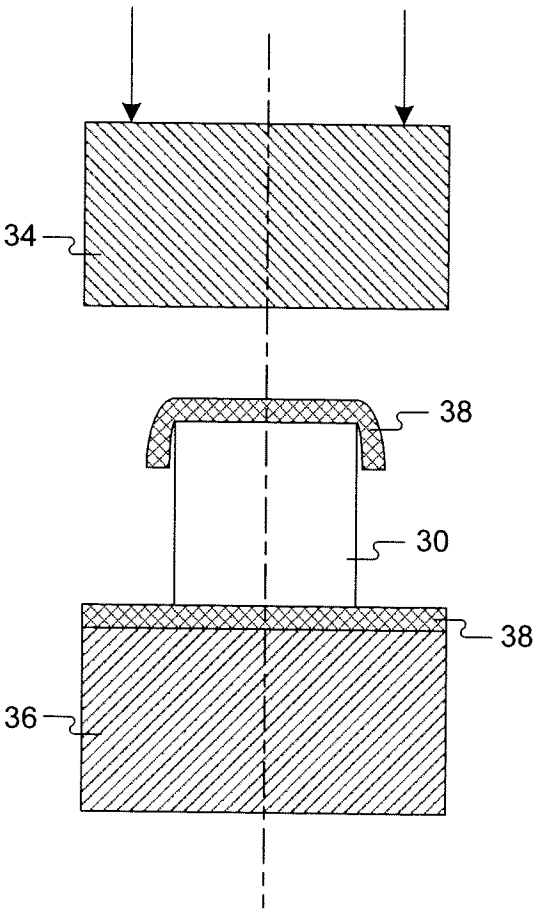
FIGS. 3B and 3D are cross-sectional schematic diagrams illustrating an identical open-die forging operation employing solid lubricant sheets according to processes disclosed herein.
Figure 3A:
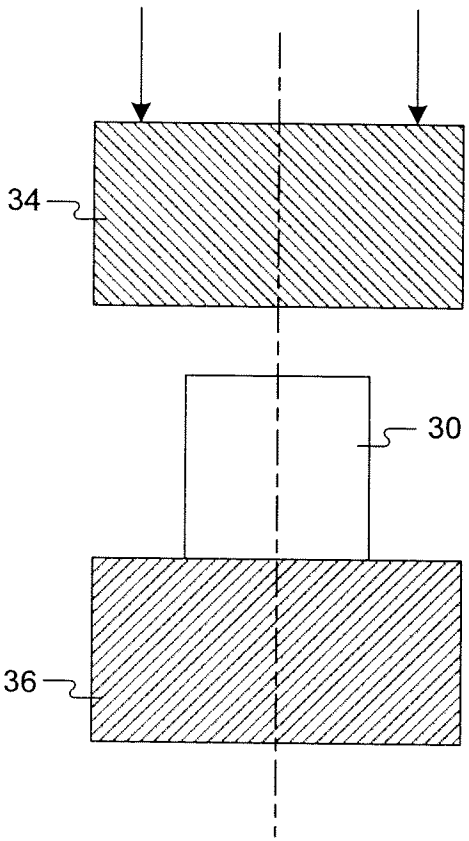
FIGS. 3A and 3C are cross-sectional schematic diagrams illustrating an open-die forging operation without solid lubricant sheets.
Figure 3D:
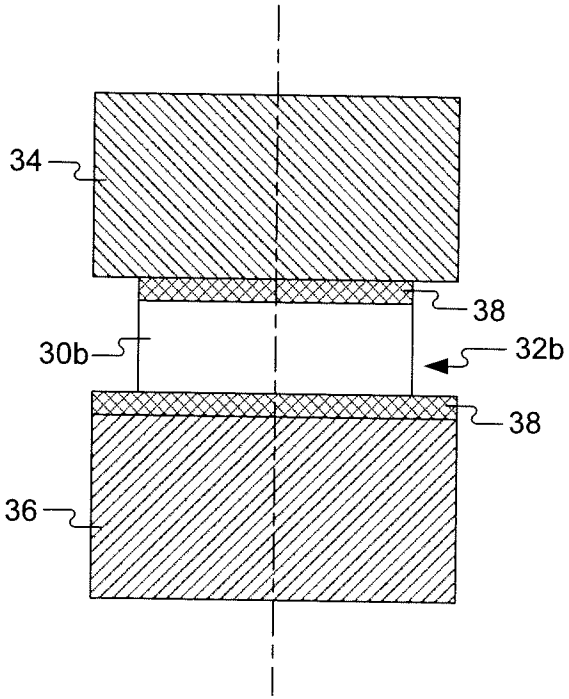
Figure 3C:
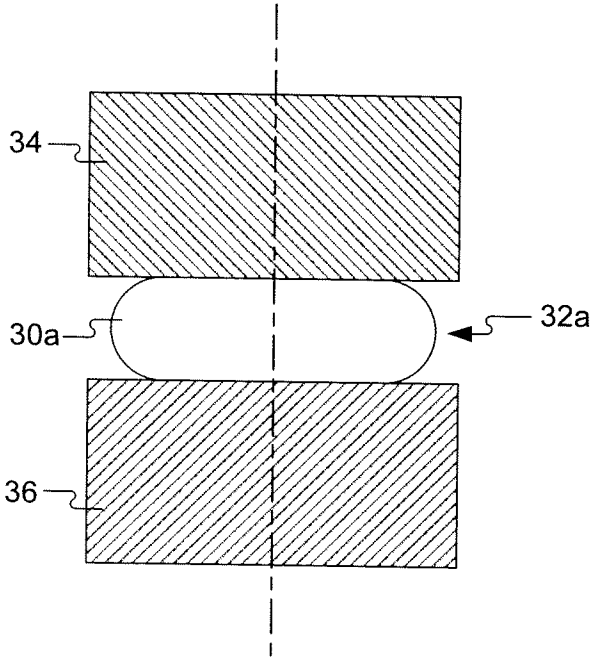

FIGS. 3A through 3D illustrate open flat-die press forging operations. FIGS. 3A and 3C show a forging operation without solid lubricant sheets and FIGS. 3B and 3D show an identical forging operation employing solid lubricant sheets according to the processes disclosed herein. The upper dies 34 press the workpieces 30 from their initial height to a forged height. The pressing force is applied to the workpieces 30 by the upper dies 34 and the lower dies 36. The material of the workpieces 30 is incompressible and, therefore, the volumes of the initial workpieces 30 and the forged workpieces 30*a* and 30*b* are equal. With no lubricant, the forged workpiece 30*a* shown in FIG. 3C does not deform uniformly and exhibits barreling at 32*a* due to the relatively high friction between the workpiece 30 and the dies 34 and 36.

As illustrated in FIG. 3B, solid lubricant sheets 38 are positioned between the workpiece 30 and the upper and lower dies 34 and 36, respectively. A solid lubricant sheet 38 is positioned on the lower die 36 and the workpiece 30 is positioned on the solid lubricant sheet 38. An additional solid lubricant sheet 38 is positioned on the top surface of the workpiece 30. The solid lubricant sheets 38 are flexible and capable of being positioned to drape over the workpiece 38. With the solid lubricant sheets 38, the forged workpiece 30*b* shown in FIG. 3D deforms more uniformly and exhibits less barreling at 32*b* due to the decreased friction between the workpiece 30 and the dies 34 and 36.

Figure 4B:
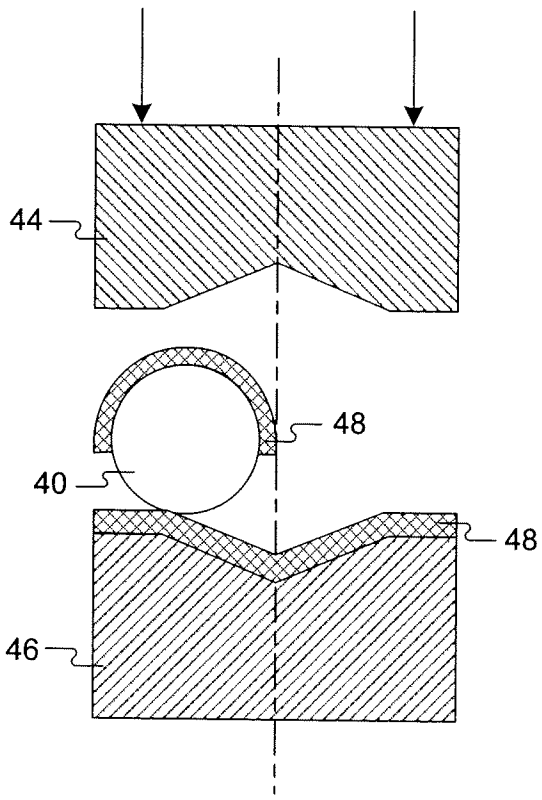
FIGS. 4B, 4D, and 4F are cross-sectional schematic diagrams illustrating an identical open-die forging operation employing solid lubricant sheets according to processes disclosed herein.
Figure 4A:
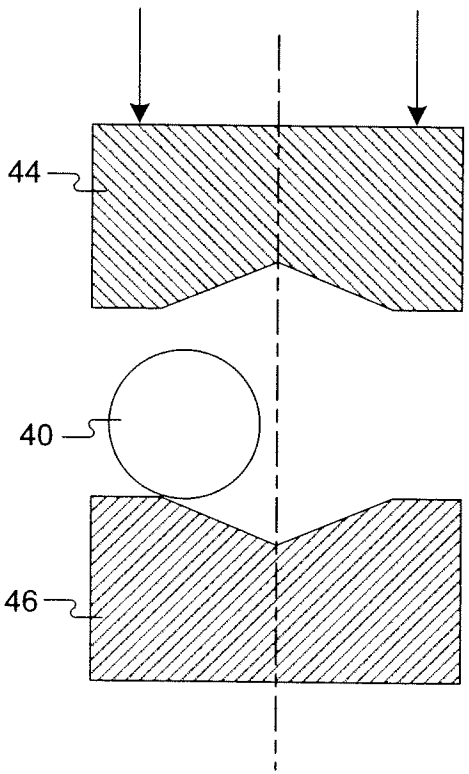
FIGS. 4A, 4C, and 4E are cross-sectional schematic diagrams illustrating an open-die forging operation without solid lubricant sheets.
Figure 4D:
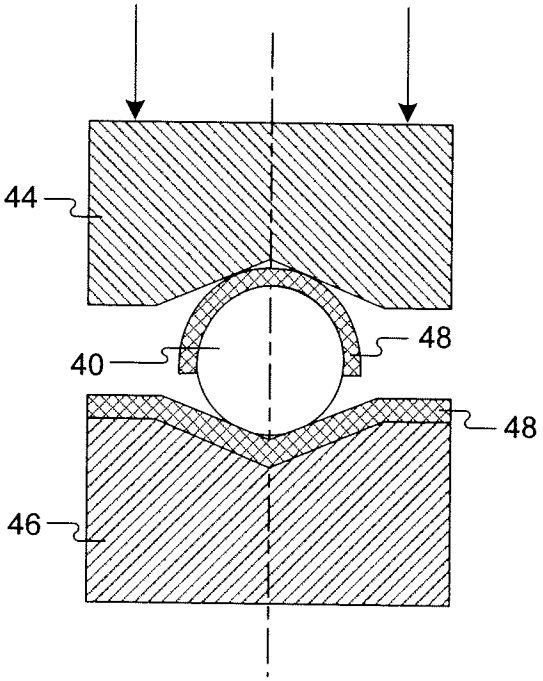
Figure 4C:
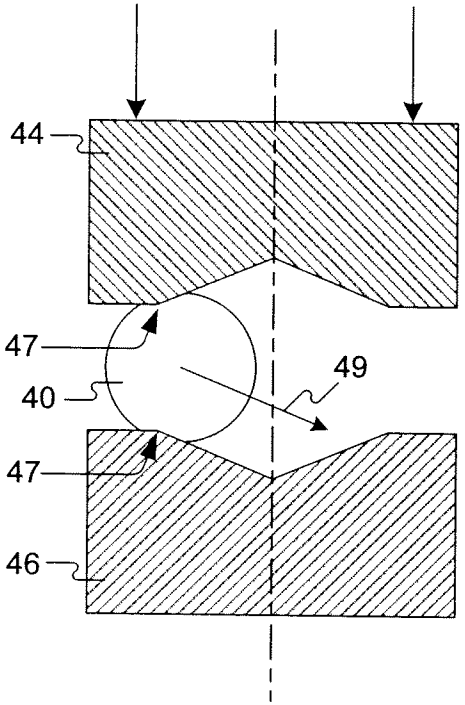
Figure 4F:
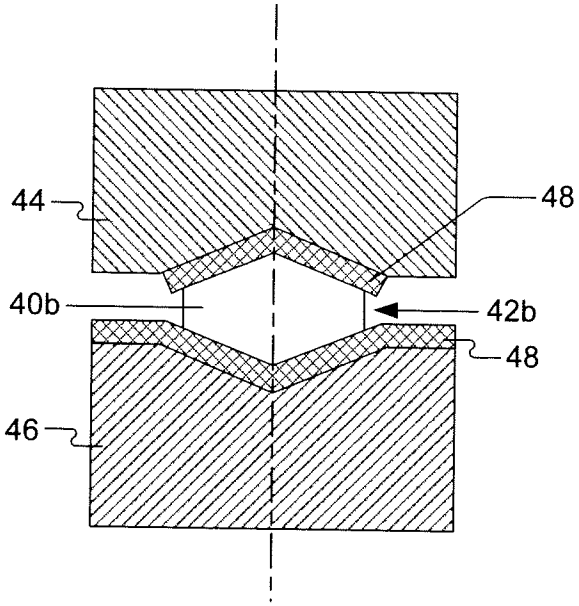
Figure 4E:
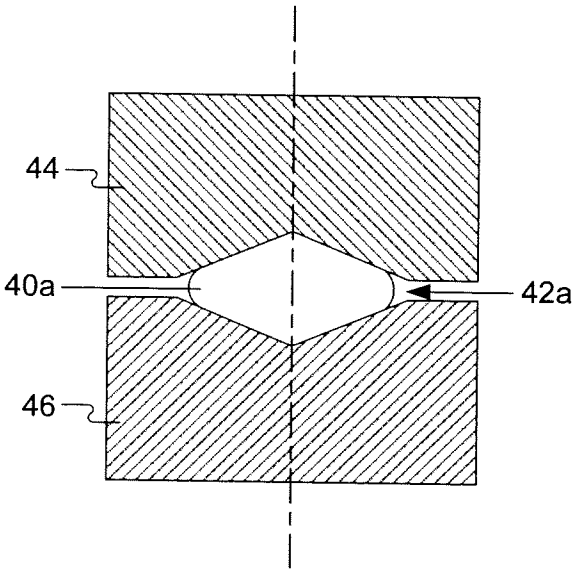

FIGS. 4A through 4F illustrate open V-shaped die forging operations. FIGS. 4A, 4C, and 4E show forging operation without solid lubricant sheets, and FIGS. 4B, 4D, and 4F show an identical forging operation employing solid lubricant sheets according to the processes disclosed herein. FIGS. 4A and 4B show the workpieces 40 positioned off-center with respect to the V-shaped die cavities. As illustrated in FIG. 4B, solid lubricant sheets 48 are positioned between the workpiece 40 and the upper and lower dies 44 and 46, respectively. A solid lubricant sheet 48 is positioned on the lower die 46 and the workpiece 40 is positioned on the solid lubricant sheet 48. An additional solid lubricant sheet 48 is positioned on the top surface of the workpiece 40. The solid lubricant sheets 48 are flexible and capable of being positioned to match the contour of the V-shaped cavity of the lower die 46 and to drape over the workpiece 48.

FIGS. 4C and 4D show the workpieces 40 just as contact is being made with upper dies 44 and pressure is beginning to be applied to the workpieces 40. As shown in FIG. 4C, during the press stroke as the upper die 44 makes contact with the workpiece 40 without lubrication, the high friction between the contacting surfaces of the workpiece 40 and the dies 44 and 46 causes the workpiece to stick to the dies as indicated at 47. This phenomenon, which may be referred to as "die-locking", may be particularly undesirable in forging operations involving a contoured die surface in which a workpiece positioned off-center may die-lock and not properly deform to take on the contours of the die.

During a press stroke in a forging operation without lubrication, a workpiece may die-lock until the pressing force overcomes the sticking friction forces. When the pressing force overcomes the sticking friction forces in a non-lubricated forging operation, the workpiece may rapidly accelerate inside the forging apparatus. For example, as illustrated in FIG. 4C, then the pressing force overcomes the sticking friction forces between the workpiece 40 and the dies 44 and 46 (indicated at 47), the workpiece 40 may rapidly accelerate downwardly into the center of the V-shaped cavity of the die 46 as indicated by arrow 49.

The rapid acceleration of a workpiece inside a forging apparatus may damage the workpiece, the forging apparatus, or both. For example, when the pressing force exceeds the sticking friction forces, the workpiece and/or the dies may gall, i.e., material may be undesirably removed from the localized contact areas that seized during the die-locking (e.g., areas 47 in FIG. 4C). Further, a forged workpiece may be marred, scratched, chipped, cracked, and/or fractured if the workpiece accelerates within the forging apparatus. Die-locking also adversely affects the ability to maintain dimensional control over forged articles. In addition, rapid movement within a forging apparatus may cause forceful impacting with surfaces of components of the forging apparatus and shaking of the forging apparatus, which may damage the forging apparatus or otherwise shorten the lifespan of components of the forging apparatus.

During a press stroke in a forging operation with a solid lubricant sheet, an off-center workpiece does not experience die-locking because of the decrease in friction. The solid lubricant sheet significantly decreases or eliminates sticking friction and, therefore, no unacceptably rapid acceleration of the workpiece occurs. Instead, a relatively smooth self-centering action occurs as the upper die contacts the workpiece or a lubricant sheet on the workpiece. For example, as illustrated in FIG. 4D, when the upper die 44 contacts the workpiece 40, the solid lubricant sheets 48 significantly reduce or eliminate sticking friction and decrease sliding friction so that the workpiece 40 smoothly self-centers down into the V-shaped cavity of the die 46.

FIGS. 4E and 4F show forged workpieces 40*a* and 40*b*, without lubricant and with solid lubricant sheets 48, respectively. The forged workpiece 40*a* shown in FIG. 4E does not deform uniformly during forging without lubricant and exhibits barreling at 42*a* due to the relatively high friction between the workpiece 40 and the dies 44 and 46. The forged workpiece 40*b* shown in FIG. 4F deforms more uniformly during forging with the solid lubricant sheets 48 and exhibits less barreling at 42*b* due to the decreased friction between the workpiece 40 and the dies 44 and 46.

Figure 5A:
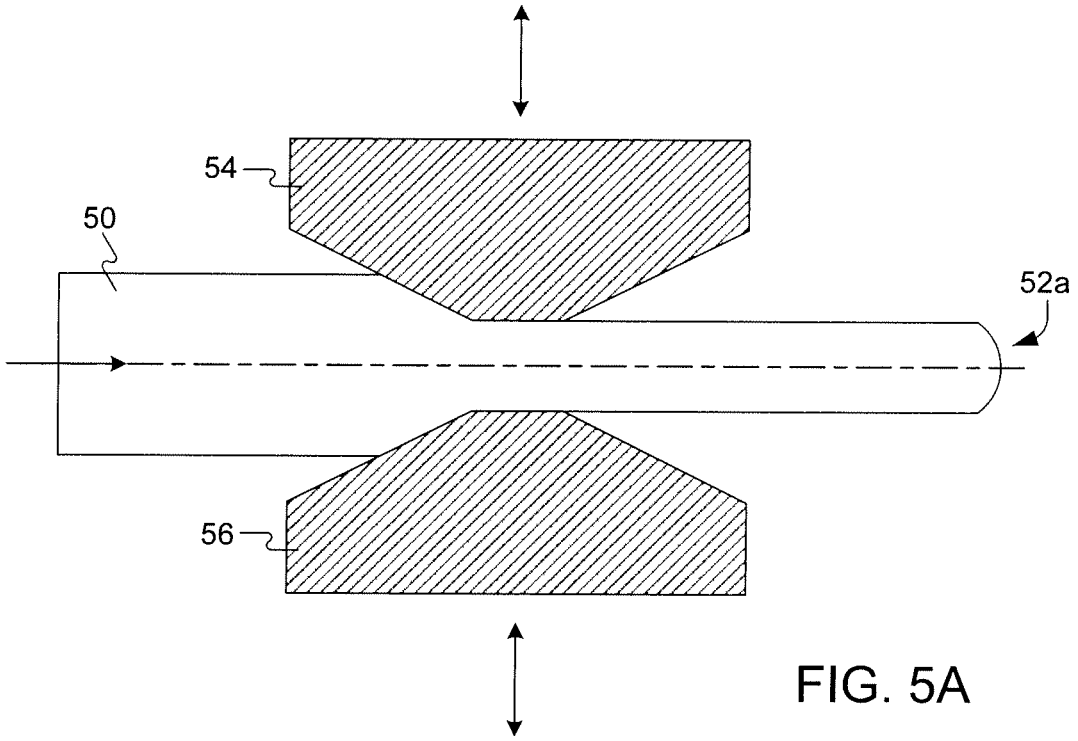
FIG. 5A is a cross-sectional schematic diagram illustrating a radial forging operation without solid lubricant sheets.
Figure 5B:
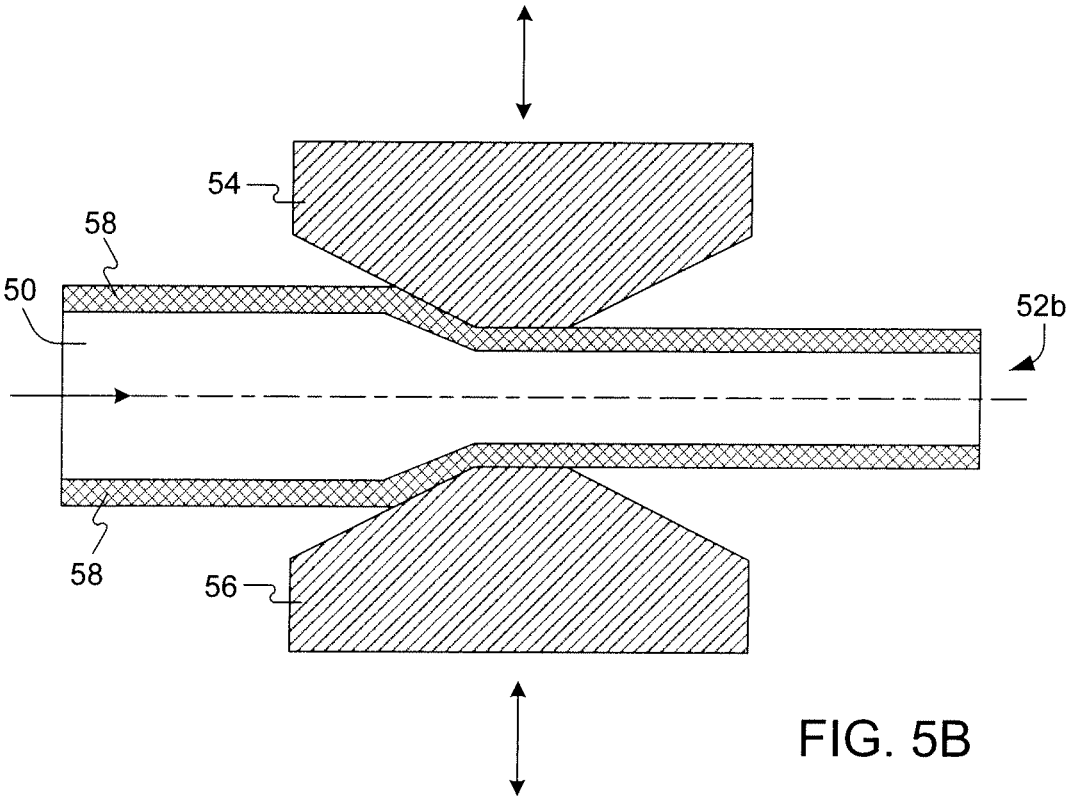
FIG. 5B is a cross-sectional schematic diagram illustrating an identical radial forging operation employing a solid lubricant sheet according to processes disclosed herein.

FIGS. 5A and 5B illustrate radial forging operations. FIG. 5A shows a radial forging operation without solid lubricant sheets and FIG. 5B shows an identical radial forging operation employing a solid lubricant sheet according to the processes disclosed herein. The diameter of a cylindrical workpiece 50 is reduced by dies 54 and 56 that move in radial directions relative to the workpiece 50, which moves longitudinally relative to the dies 54 and 56. As shown in FIG. 5A, a radial forging operation performed without lubricant may result in non-uniform deformation as indicated at 52*a*. The radial forging operation shown in FIG. 5B is performed with a solid lubricant sheet 58 wrapping the workpiece 50 according to the processes disclosed herein. For example, workpiece 50 may be wrapped with the solid lubricant sheet 58 as illustrated in FIG. 2A or 2B, above. As shown in FIG. 5B, a radial forging operation performed with a solid lubricant sheet may result in more uniform deformation as indicated at 52*b*.

Figure 6B:
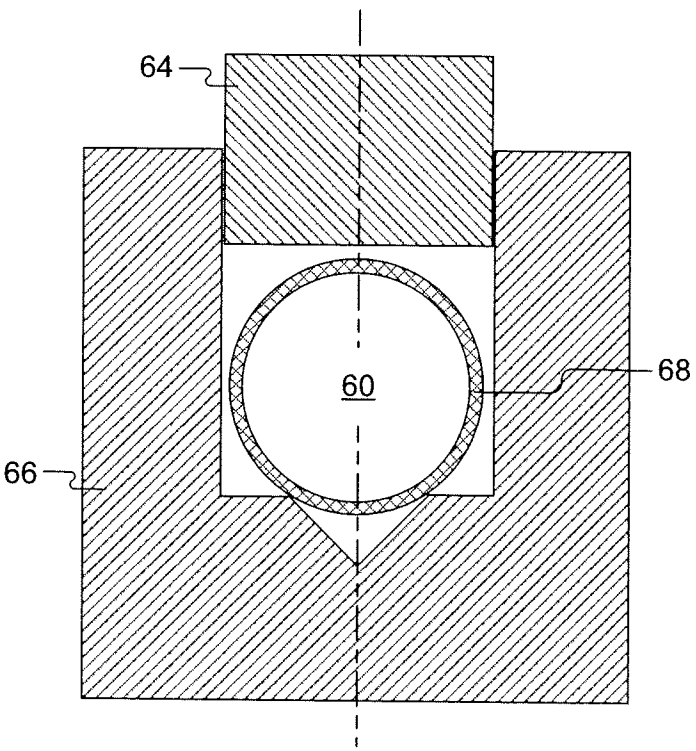
FIGS. 6B and 6D are cross-sectional schematic diagrams illustrating an identical closed-die forging operation employing solid lubricant sheets according to processes disclosed herein.
Figure 6A:
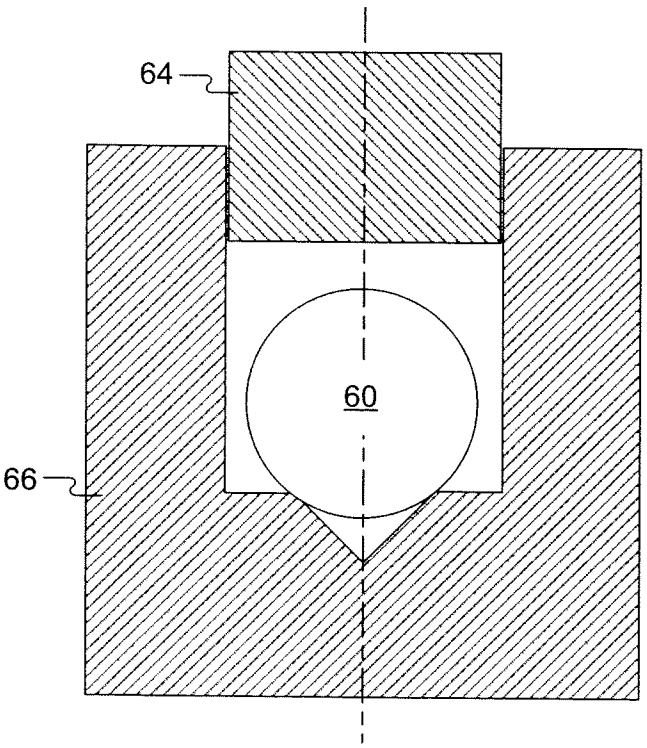
FIGS. 6A and 6C are cross-sectional schematic diagrams illustrating a closed-die forging operation without solid lubricant sheets.
Figure 6D:
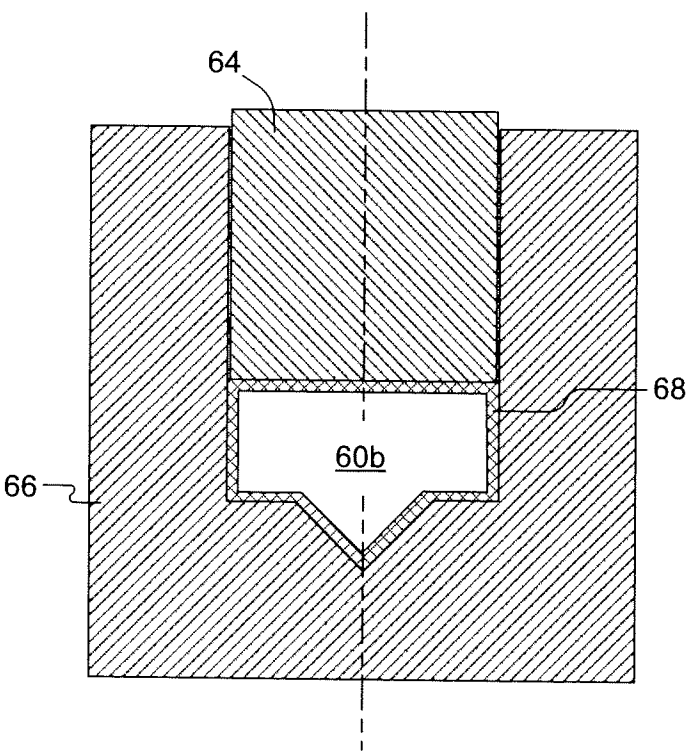
Figure 6C:
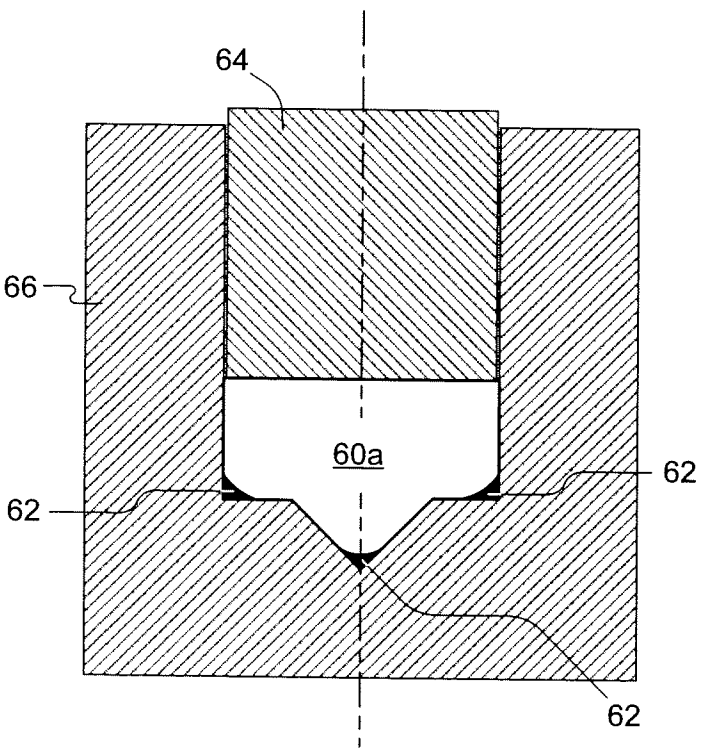

FIGS. 6A through 6D illustrate closed-die press forging operations, which may be net-shape or near-net-shape forging operations. FIGS. 6A and 6C show a closed-die press forging operation without solid lubricant sheets and FIGS. 6B and 6D show an identical forging operation employing solid lubricant sheets according to the processes disclosed herein. The upper dies or punches 64 press the workpieces 60 into the die cavities of lower dies 66. The workpiece 60*a* shown in FIG. 6C does not deform uniformly during forging without lubricant and does not completely fill the die cavities, as indicated at 62, due to the relatively high friction between the workpiece 60 and the lower die 66. This may be particularly problematic for net-shape and near-net-shape closed die forging operations wherein the forged workpiece is intended to be a completely-formed article or a nearly-formed article with little or no subsequent forging or machining.

As illustrated in FIG. 6B, the workpiece 60 is wrapped in a solid lubricant sheet 68. The solid lubricant sheet 68 is flexible and conforms to the surfaces of the workpiece 60. The workpiece 60*b* shown in FIG. 6D deforms more uniformly because of decreased friction due to the solid lubricant sheet 68, and completely conforms to the contoured surfaces and cavities of the enclosed dies 64 and 66.

In various embodiments, the solid lubricant sheets disclosed herein may be used in combination with separate insulating sheets. As used herein, an "insulating sheet" is a sheet of solid material intended to thermally insulate a workpiece from the working surfaces of dies in a forging apparatus. For example, an insulating sheet may be positioned between a solid lubricant sheet and a workpiece surface, and/or an insulating sheet may be positioned between a solid lubricant sheet and a die surface. In addition, an insulating sheet may be sandwiched between two solid lubricant sheets, and the sandwiched sheets positioned between a workpiece and a die in a forging apparatus. FIGS. 7A through 7D illustrate various configurations of solid lubricant sheets 78 and insulating sheets 75 in relation to workpieces 70 and dies 74 and 76 in a forging apparatus.

Figure 7A:
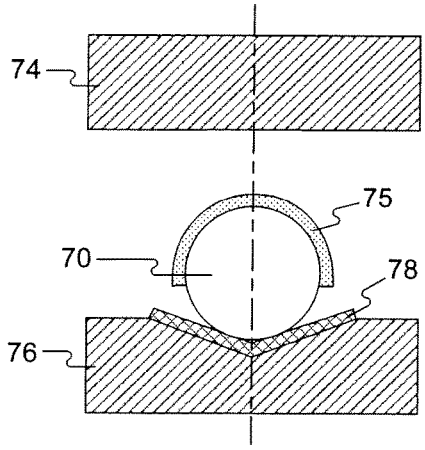
FIGS. 7A, 7B, 7C, and 7D are cross-sectional schematic diagrams illustrating various configurations of solid lubricant sheets and insulating sheets in relation to the workpiece and dies in a forging apparatus.

FIG. 7A shows a solid lubricant sheet 78 positioned on a working surface of a lower die 76. A workpiece 70 is positioned on the solid lubricant sheet 78 on the lower die 76. In this manner, the solid lubricant sheet 78 is positioned between a bottom surface of the workpiece 70 and the lower die 76. An insulating sheet 75 is positioned on a top surface of the workpiece 70.

Figure 7B:
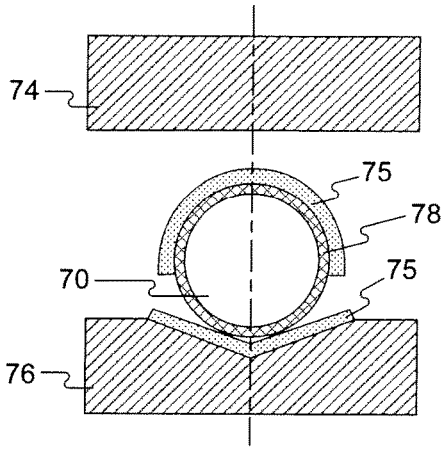

FIG. 7B shows an insulating sheet 75 positioned on a working surface of a lower die 76 in a press forging apparatus. A workpiece 70 is wrapped in a solid lubricant sheet 78. The wrapped workpiece 70 is positioned on the insulating sheet 75 on the lower die 76. In this manner, a solid lubricant sheet 78 and an insulating sheet 75 are positioned between a bottom surface of the workpiece 70 and the lower die 76. An insulating sheet 75 is positioned between the solid lubricant sheet 78 and the lower die 76. Another insulating sheet 75 is positioned on the solid lubricant sheet 78 on a top surface of the workpiece 70. In this manner, a solid lubricant sheet 78 and an insulating sheet 75 are also positioned between a top surface of the workpiece 70 and the upper die 74. An insulating sheet 75 is positioned between the solid lubricant sheet 78 and the upper die 74.

Figure 7C:
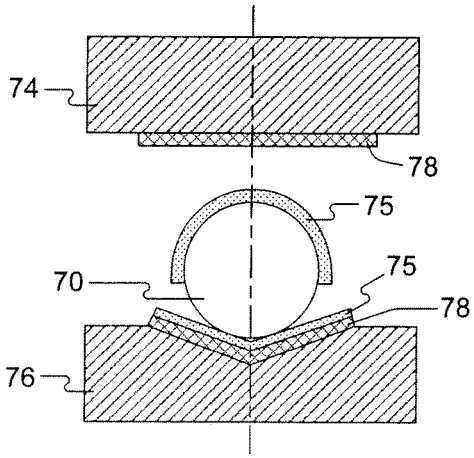

FIG. 7C shows solid lubricant sheets 78 positioned on working surfaces of both the upper die 74 and the lower die 76. An insulating sheet 75 is positioned on the solid lubricant sheet 78 on the lower die 76. The workpiece 70 is positioned on the insulating sheet 75 so that both an insulating sheet 75 and a solid lubricant sheet 78 are positioned between the workpiece and the lower die 76. Another insulating sheet 75 is positioned on a top surface of the workpiece 70 so that both an insulating sheet 75 and a solid lubricant sheet 78 are positioned between the workpiece and the upper die 74.

Figure 7D:
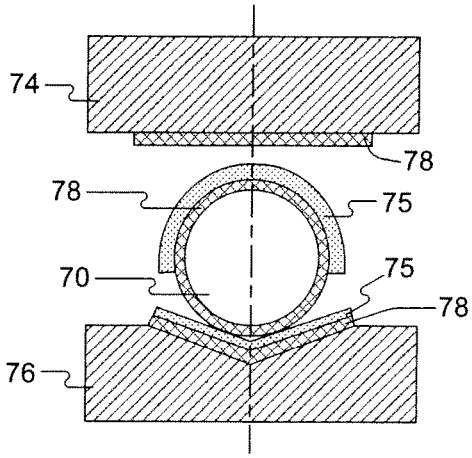

FIG. 7D shows solid lubricant sheets 78 positioned on working surfaces of both the upper die 74 and the lower die 76. An insulating sheet 75 is positioned on the solid lubricant sheet 78 on the lower die 76. A workpiece 70 is wrapped in a solid lubricant sheet 78. The workpiece 70 is positioned on the insulating sheet 75 so that three layers are positioned between the workpiece 70 and the lower die 76, i.e., a solid lubricant sheet 78, an insulating sheet 75, and another solid lubricant sheet 78. Another insulating sheet 75 is positioned on the solid lubricant sheet on a top surface of the workpiece 70 so that three layers are positioned between the workpiece 70 and the upper die 74, i.e., a solid lubricant sheet 78, an insulating sheet 75, and another solid lubricant sheet 78.

Although various configurations of solid lubricant sheets and insulating sheets in relation to workpieces and dies in a forging apparatus are described and illustrated herein, embodiments of the disclosed processes are not limited to the explicitly disclosed configurations. As such, various other configurations of solid lubricant sheets and insulating sheets in relation to workpieces and dies are contemplated by the present disclosure. Likewise, while various techniques and combinations of techniques for positioning solid lubricant sheets and/or insulating sheets are disclosed herein (such as, for example, laying, draping, wrapping, adhering, and the like), the disclosed processes are not limited to the explicitly disclosed positioning techniques and combinations of positioning techniques. For example, various other combinations of laying, draping, wrapping, adhering, and the like may be used to apply and position solid lubricant sheets and/or insulating sheets in relation to workpieces and dies, before and/or after a workpiece is positioned in a forging apparatus.

Insulating sheets may be flexible and capable of being positioned in cavities and over contours and non-planar surfaces of forging dies and/or workpieces. In various embodiments, the insulating sheets may comprise woven or non-woven ceramic fiber blankets, mats, papers, felts, and the like. The insulating sheet may consist of ceramic fibers (such as, for example, metal oxide fibers) and residual impurities, and contain no binders or organic additives. For example, suitable insulating sheets may comprise blends of predominantly alumina and silica fibers and lesser amounts of other oxides. Ceramic fiber insulating sheets suitable for the processes disclosed herein include, for example, the various Fiberfrax® materials available from Unifrax, Niagara Falls, N.Y., USA.

In various embodiments, sandwich structures comprising multiple solid lubricant sheets may be positioned between a workpiece and a die in a forging apparatus. For example, a sandwich structure comprising two or more layers of solid lubricant sheet may be positioned between a workpiece and a die in a forging apparatus. The sandwich structures may also comprise one or more insulating sheets. In addition, multiple solid lubricant sheets may be applied to cover larger areas. For example, two or more solid lubricant sheets may be applied to dies and/or workpieces to cover more surface area than individual solid lubricant sheets can cover. In this manner, two or more solid lubricant sheets may be applied to a die and/or a workpiece in an overlapping or non-overlapping fashion.

The lubrication processes disclosed herein may be applied to cold, warm, and hot forging operations at any temperature. For example, a solid lubricant sheet may be positioned between a workpiece and a die in a forging apparatus wherein the forging occurs at ambient temperatures. Alternatively, workpieces and/or dies may be heated before or after the positioning of a solid lubricant sheet between the workpieces and dies. In various embodiments, a die in a forging apparatus may be heated with a torch either before or after a solid lubricant sheet is applied to the die. A workpiece may be heated in a furnace either before or after a solid lubricant sheet is applied to the workpiece.

In various embodiments, a workpiece may be plastically deformed while the workpiece is at a temperature greater than 1000° F., wherein the solid lubricant sheet maintains lubricity at the temperature. In various embodiments, a workpiece may be plastically deformed while the workpiece is at a temperature in the range of 1000° F. to 2000° F., or any sub-range therein, such as, for example, 1000° F. to 1600° F. or 1200° F. to 1500° F., wherein the solid lubricant sheet maintains lubricity at the temperature.

The processes disclosed herein provide a robust method for forge lubrication. In various embodiments, solid lubricant sheets may deposit a solid lubricant coating on the dies during an initial forging operation. The deposited solid lubricant coatings may survive the initial forging operation and one or more subsequent forging operations. The surviving solid lubricant coatings on the dies maintain lubricity and may provide effective forge lubrication over one or more additional forging operations on the same workpiece and/or different workpieces without the need to apply additional solid lubricant sheets.

In various embodiments, a solid lubricant sheet may be positioned between a workpiece and a die before a first forging operation to deposit a solid lubricant coating on the die, and additional solid lubricant sheets may be applied after a predetermined number of forging operations. In this manner, a duty cycle for an application of solid lubricant sheets may be established in terms of the number of forging operations that may be performed without additional applications of solid lubricant sheets while maintaining acceptable lubricity and forge lubrication. Additional solid lubricant sheets may then be applied after each duty cycle. In various embodiments, the initial solid lubricant sheets may be relatively thick to deposit an initial solid lubricant coating on the dies, and the subsequently applied solid lubricant sheets may be relatively thin to maintain the deposited solid lubricant coating.

The processes disclosed herein are applicable to the forging of various metallic materials, such as, for example, titanium, titanium alloys, zirconium, and zirconium alloys. In addition, the processes disclosed herein are applicable to the forging of inter-metallic materials, non-metallic deformable materials, and multi-component systems, such as, for example, metal encapsulated ceramics. The processes disclosed herein are applicable to the forging of various types of workpieces, such as, for example, ingots, billets, bars, plates, tubes, sintered pre-forms, and the like. The processes disclosed herein are also applicable to the net-shape and near-net-shape forging of formed or nearly formed articles.

In various embodiments, the lubrication processes disclosed herein may be characterized by shear friction factors (m) of less than or equal to 0.50, less than or equal to 0.45, less than or equal to 0.40, less than or equal to 0.35, less than or equal to 0.30, less than or equal to 0.25, less than or equal to 0.20, less than or equal to 0.15, or less than or equal to 0.10. In various embodiments, the lubrication processes disclosed herein may be characterized by shear factors in the range of 0.05 to 0.50 or any sub-range therein, such as, for example, 0.09 to 0.15. As such, the lubrication processes disclosed herein substantially decrease friction between dies and workpieces in forging operations.

In various embodiments, the lubrication processes disclosed herein may decrease or eliminate the incidence of die locking, sticking, and/or galling of the workpieces in forging operations. Liquid or particulate lubricants are not readily applied when also using insulating sheets in forging operations, but the disclosed lubrication processes allow for the simultaneous use of insulating sheets, which substantially decreases heat losses from workpieces to dies. Liquid or particulate lubricants also tend to thin out over the surfaces of dies and workpieces and disperse after each forging operation, but solid lubricant sheets may create a stable barrier between dies and workpieces in forging operations. Solid-state lubricants, such as, for example, graphite, molybdenum disulfide, tungsten disulfide, and boron nitride, are also generally chemically inert and non-abrasive with respect to metallic dies and workpieces under forging conditions.

In various embodiments, solid lubricant deposited on dies and workpieces from solid lubricant sheets during forging operations may be removed. For example, deposited graphite may be readily removed from the surfaces of dies and workpieces by heating in an oxidizing atmosphere, such as, for example, in a furnace. Deposited solid lubricant may also be removed by a washing procedure.

The illustrative and non-limiting examples that follow are intended to further describe various non-limiting embodiments without restricting the scope of the embodiments. Persons having ordinary skill in the art will appreciate that variations of the Examples are possible within the scope of the invention as defined by the claims.

EXAMPLES

Example 1

Ring compression testing was used to evaluate the lubricity of solid graphite sheets and their effectiveness as a lubricant for open die press forging of Ti-6Al-4V alloy (ASTM Grade 5). Ring compression testing is generally described, for example, in Atlan et al., *Metal Forming: Fundamentals and Applications*, Ch.6. Friction in Metal Forming, ASM: 1993, which is incorporated by reference herein. Lubricity, quantified as the shear factor (m) of a system, is measured using a ring compression test in which a flat ring-shaped specimen is compressed to a predetermined reduction in height. The change in the inner and outer diameter of the compressed ring is dependent upon the friction at the die/specimen interface.

Figure 8:
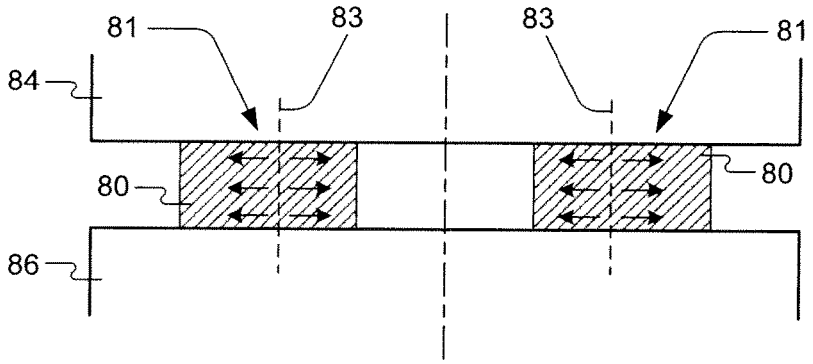
FIG. 8 is a cross-sectional schematic diagram illustrating the general set-up of a ring compression test.
Figure 9:
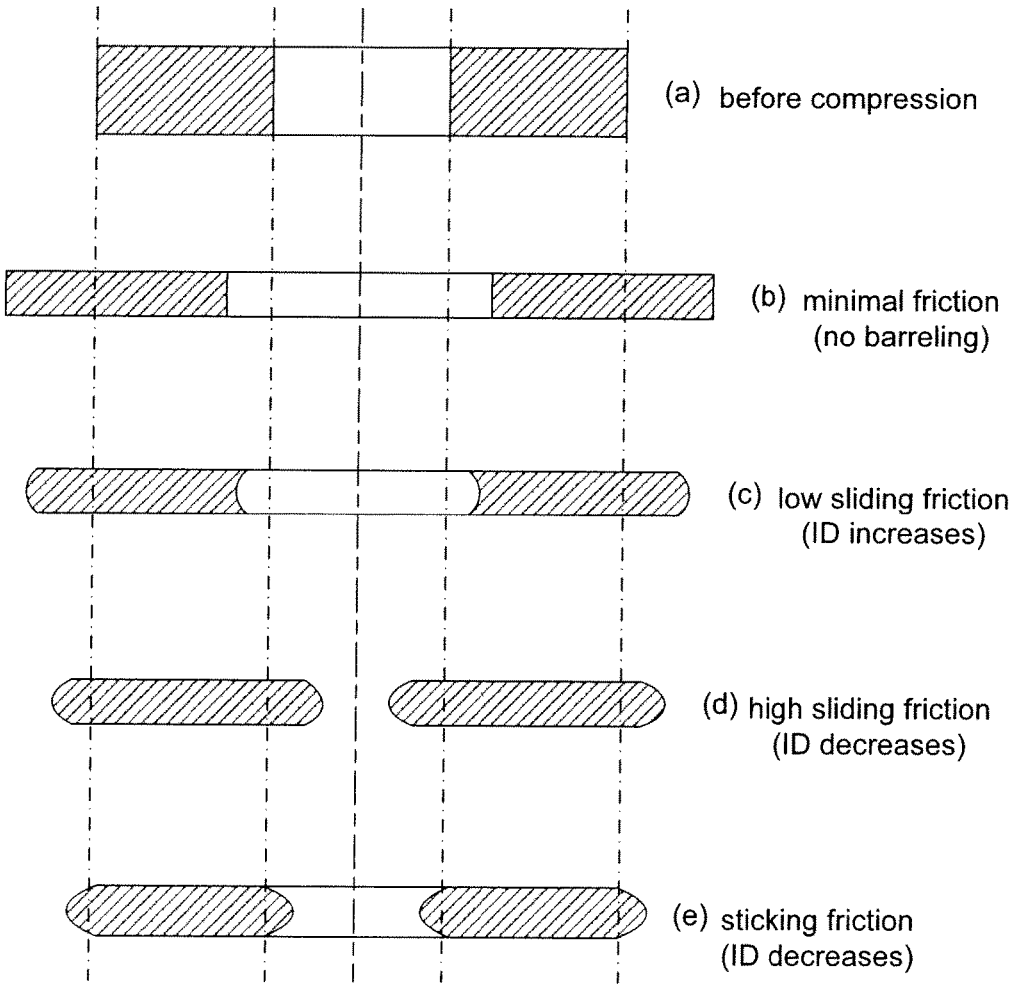
FIG. 9 is a cross-sectional schematic diagram illustrating the shapes of rings compressed under various frictional conditions in a ring compression test.
Figure 10A:
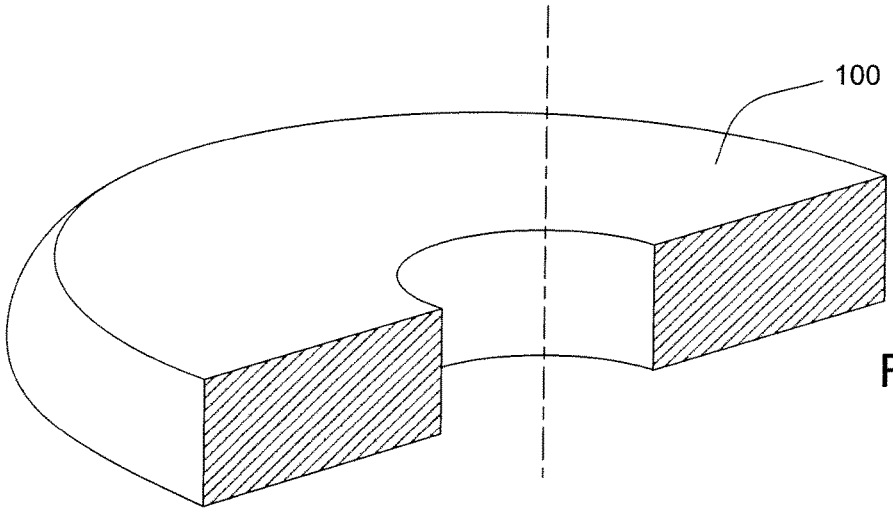
FIG. 10A is a perspective sectional view of a ring specimen before compression in a ring compression test.
Figure 10B:
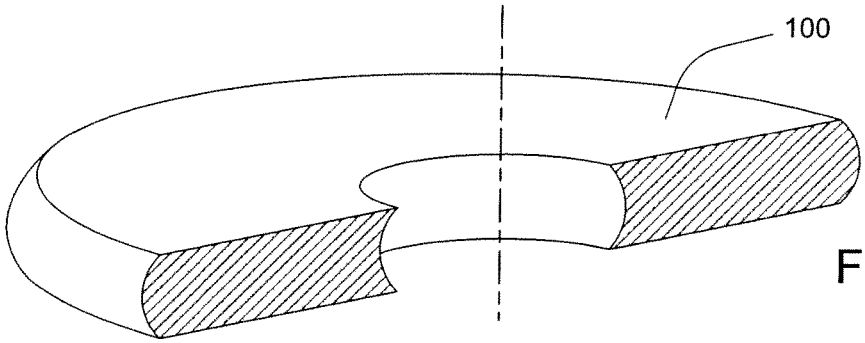
FIG. 10B is a perspective sectional view of a ring specimen after compression with relatively low friction in a ring compression test.
Figure 10C:
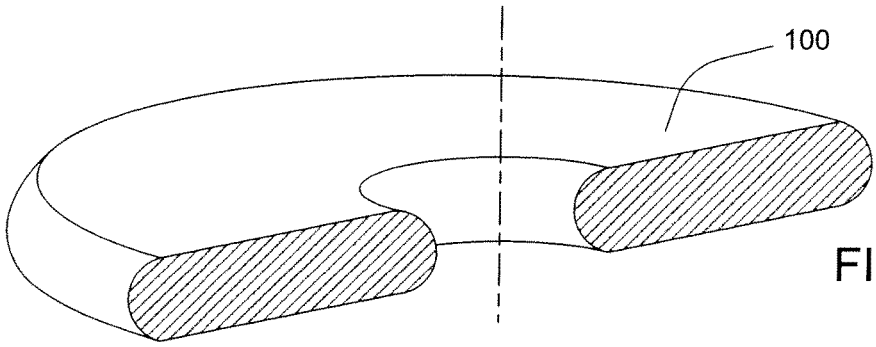
FIG. 10C is a perspective sectional view of a ring specimen after compression with relatively high friction in a ring compression test.

The general set-up of a ring compression test is shown in FIG. 8. A ring 80 (shown in cross-section) is positioned between two dies 84 and 86 and axially compressed from an initial height to a deformed height. If no friction existed between ring 80 and dies 84 and 86, the ring 80 would deform as a solid disk with the material flowing radially outward from neutral plane 83 at a constant rate along the axial direction as indicated by arrows 81. The ring is shown before compression in FIG. 9(*a*). No barreling would occur for frictionless or minimal frictional compression (FIG. 9(*b*)). The inner diameter of a compressed ring increases if friction is relatively low (FIG. 9(*c*)) and decreases if friction is relatively high (FIGS. 9(*d*) and 9(*e*)). FIG. 10A shows a sectioned ring specimen 100 before compression, FIG. 10B shows the ring 100 compressed under relatively low friction conditions, and FIG. 10C shows the ring 100 compressed under relatively high friction conditions.

The change in the inner diameter of a compressed ring, measured between the apex of the inner bulge of the barreling, is compared to values for the inner diameter predicted using various shear factors. The correlations between compressed inner diameter and shear factor may be determined, for example, using computational finite element methods (FEM) simulating the metal flow in ring compression with barreling for predetermined materials under predetermined forging conditions. In this manner, the shear factor may be determined for a ring compression test that characterizes the friction, and by extension, the lubricity of the tested system.

Figure 11A:
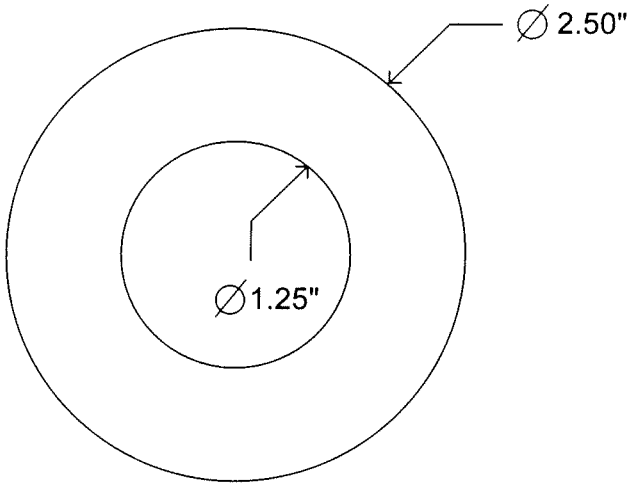
FIG. 11A is a top view of a ring specimen before compression in a ring compression test.
Figure 11B:
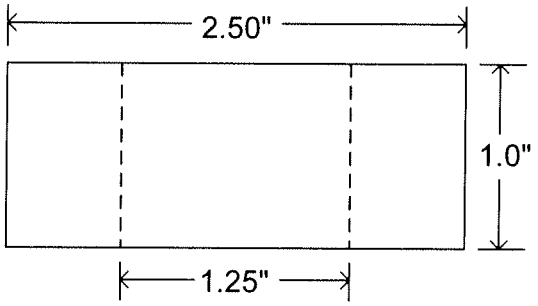
FIG. 11B is a side view of a ring specimen before compression in a ring compression test.
Figure 12:
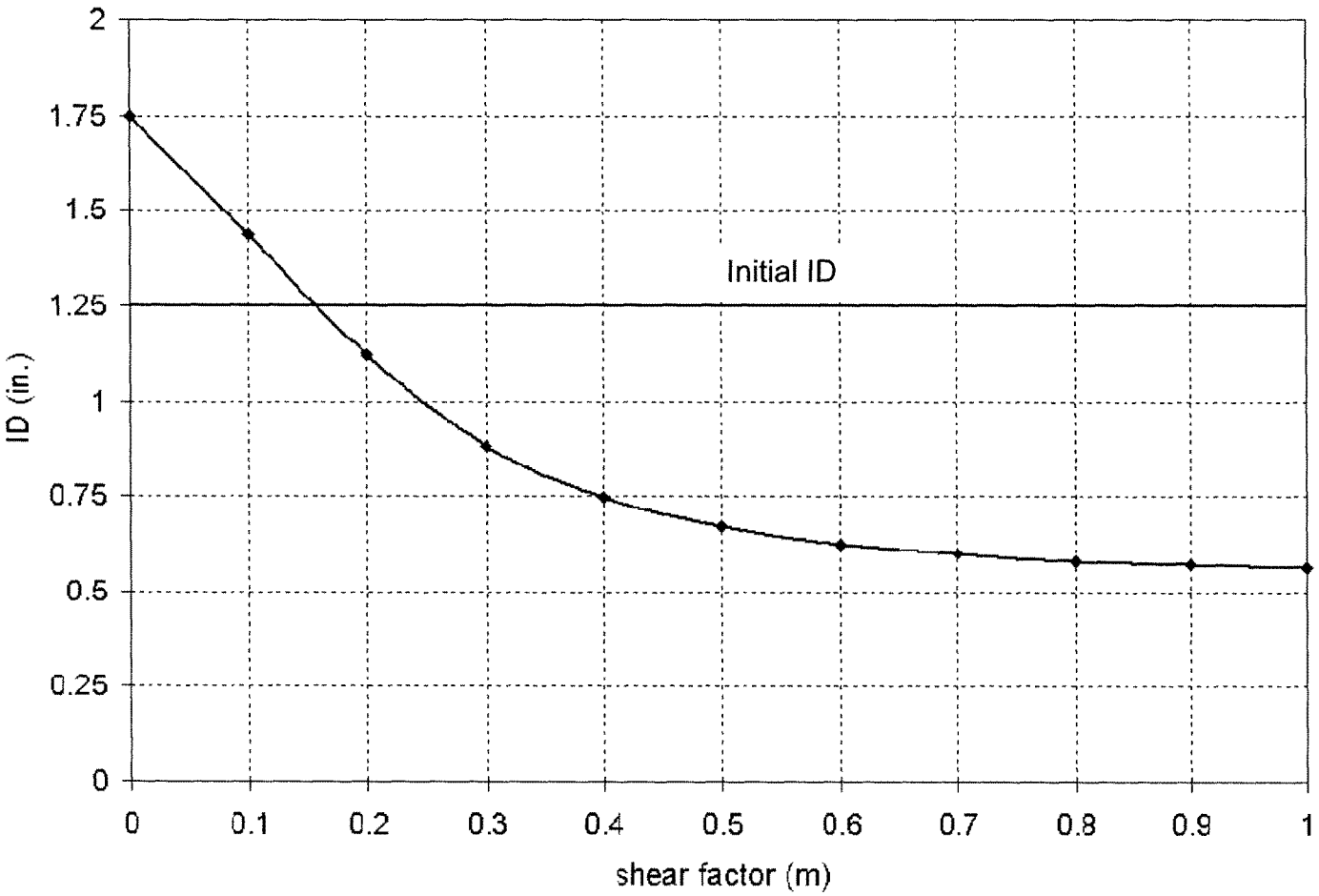
FIG. 12 is graph of the correlation between compressed inner diameter and shear factor for a ring compression test of Ti-6Al-4V alloy.

Rings of Ti-6Al-4V alloy (ASTM Grade 5) having an inner diameter of 1.25", an outer diameter of 2.50", and a height of 1.00" (FIGS. 11A and 11B) were used for the ring compression testing. The rings were heated to a temperature in the range 1200-1500° F. and compressed in an open-die press forging apparatus to a deformed height of 0.50". The correlation between compressed inner diameter (ID) and shear factor (m) were determined using DEFORM™ metal forming process simulation software, available from Scientific Forming Technologies Corporation, Columbus, Ohio, USA. The correlation is shown in the graph presented in FIG. 12.

The rings were compressed (1) between 400-600° F. dies with no lubricant, (2) between 400-600° F. dies with a glass lubricant (ATP300 glass frit available from Advanced Technical Products, Cincinnati, Ohio, USA), (3) between 1500° F. dies with no lubricant, (4) between 1500° F. dies with glass lubricant, and (5) between 400-600° F. dies with solid lubricant sheets (Grade B graphite sheet (>98% graphite by weight) available from DAR Industrial Products, Inc., West Conshohocken, Pa., USA). The glass lubricant, when used, was applied to the top surface of the lower die and the top surface of the ring by placing and smoothing a layer of glass frit before heating the ring to forge temperature in a furnace. The solid lubricant sheets, when used, were positioned between the lower die and the bottom surface of the ring, and on the top surface of the ring. The compressed inner diameters and corresponding shear factors are reported in Table 1 below.

TABLE 1

| | Conditions | ID (in.) | shear factor |
|---|---|---|---|
| 1 | 400-600° F. dies, no lubricant | 0.47 | >0.6 |
| 2 | 400-600° F. dies, glass lubricant | 0.47 | >0.6 |
| 3 | 1500° F. dies, no lubricant | 0.51 | >0.6 |
| 4 | 1500° F. dies, glass lubricant | 1.26, 1.38 | 0.14, 0.10 |
| 5 | ambient temperature dies, solid lubricant sheets | 1.37 | 0.10 |

The inner diameters of the rings compressed under conditions 1 and 2 decreased by 62.4%, and the inner diameter of the ring compressed under condition 3 decreased by 59.2%. This indicates very high friction between the rings and the dies. For this system, shear factors greater than 0.6 are difficult to determine accurately using the ring compression test because the correlation between shear factor and inner diameter approaches an asymptote beyond about m=0.6. However, the significant decreases in the inner diameters of the rings compressed under conditions 1-3 indicates that 0.6 is the lowest possible shear factor for these conditions, and it is likely that the actual shear factors are greater than 0.6.

The inner diameters of the rings compressed under conditions 4 and 5 increased, which indicates significantly reduced friction corresponding to shear factors of about 0.1. The solid lubricant sheets provided lubrication that was comparable to or better than the lubrication provided by glass lubricants. The high lubricity (m=0.1) at high temperatures was unexpected and surprising because the lubricity of graphite is known to significantly decrease at elevated temperatures. Generally, the friction coefficient (μ) of graphite begins to rapidly increase above about 700° F. As such, it was expected that the shear factor (m) of solid graphite sheets would be significantly greater than 0.1 between cold dies and rings at a temperature in the range 1200-1500° F.

The effectiveness of the solid lubricant sheets is also significant because glass lubricants may have a number of drawbacks when used in forging operations. For example, glass lubricants must be in a molten state and have a sufficiently low viscosity to provide lubrication between solid surfaces. As such, glass lubricants may not provide effective lubricity at forging temperatures below 1500° F., or when in contact with cold dies. Certain methods for lowering the vitrification temperature of glasses employ toxic metals, such as lead. Glass lubricants containing toxic metals may be considered unsuitable as forging lubricants. Glass lubricant must also be sprayed onto a workpiece using specialized equipment before heating of the workpiece for forging. Glass lubricants must maintain a molten state throughout a forging operation, which limits the thicknesses of glass lubricant coatings that may be deposited onto workpieces before forging.

Further, the high temperature molten glasses interfere with the transport and handling of workpieces. For example, the grips used to hold and manipulate hot workpieces while being transported from heating furnaces or lubricant application equipment to forging apparatuses often slip on high temperature glass lubricated workpieces. Further, glass lubricants may solidify on cooling articles after forging, and the brittle solidified glass may be stressed and the solid glass may forcefully fracture and spall off of forged articles in pieces. In addition, residual glass lubricant that solidifies on cooling articles after forging must be removed by mechanical methods that may reduce forging yields and may produce contaminated scrap materials.

Solid lubricant sheets overcome the above problems with glass lubricants. Solid lubricant sheets maintain a solid state throughout forging operations and may be applied before or after heating of dies and/or workpieces. Solid lubricant sheets do not require any specialized application or handling techniques, and may be positioned by hand, which allows for a more controlled and/or targeted application. Residual solid-state lubricants may be readily removed using furnace heating and/or washing procedures. Solid lubricant sheets can be applied directly to dies before workpieces are placed in forging apparatuses. Solid lubricant sheets can be applied directly to workpieces after placement in forging apparatuses. In addition, solid lubricant sheets may be flexible and/or ductile and, therefore, are significantly less likely to spall off from cooling articles after forging.

Example 2

A cylindrical billet of Ti-6Al-4V alloy (ASTM Grade 5) was press forged in a 1000 ton open-die press forge equipped with V-shaped dies, with and without solid lubricant sheets. The billet was heated in a furnace to 1300° F. The dies of the press forge were preheated with a torch 400-600° F. The billet was removed from the furnace with a manipulator and placed on the lower V-shaped die. Due to manipulator restrictions, the billet was placed off-center relative to the V-shaped contour of the lower die. For the forging operations using solid lubricant sheets, Grade HGB graphite sheet (99% graphite by weight, available from HP Materials Solutions, Inc, Woodland Hills, Calif., USA) was positioned on the lower die just before the billet was positioned on the die. A second solid lubricant sheet was positioned over the top surface of the billet. As such, the solid lubricant sheet was positioned between the billet and both the lower die and the upper die in the press forge.

During press forging of the billet without lubricant, it was observed that the billet die-locked to the lower die until the force produced by pressing overcame the friction, at which point the billet would rapidly accelerate into the V-shaped contour of the lower die, producing a loud sound and shaking the entire press forge. During press forging of the billet with a solid lubricant sheet, a self-centering action was observed in which the billet smoothly moved into the V-shaped contour of the lower die without any die-locking, rapid acceleration, loud sounds, or shaking of the press forge.

The initial solid graphite sheet deposited a solid graphite coating on the lower die during the initial forging operation. The deposited graphite coating survived the initial pressing operation and multiple subsequent pressing operations. The deposited graphite coating maintained lubricity and provided effective forge lubrication over multiple pressing operations on different portions of the billet without the need to apply additional solid graphite sheets. A single initial solid graphite sheet prevented die-locking for subsequent pressing operations.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention. Thus, it is contemplated and understood that the present disclosure embraces additional embodiments not expressly set forth herein. Such embodiments may be obtained, for example, by combining, modifying, or reorganizing any of the disclosed steps, components, elements, features, aspects, characteristics, limitations, and the like, of the embodiments described herein. In this manner, Applicants reserve the right to amend the claims during prosecution to add features as variously described herein.

What is claimed is:

1. A forge lubrication process comprising:

heating a die in a forging apparatus;

positioning a solid lubricant sheet between a metal or alloy workpiece and the heated die in the forging apparatus, wherein the solid lubricant sheet consists of at least one solid-state lubricant material and, optionally, ash, wherein the at least one solid-state lubricant material is selected from the group consisting of graphite, molybdenum disulfide, and tungsten disulfide; and applying force to the workpiece with the die to plastically deform the workpiece in air and at a workpiece temperature greater than 1000° F., wherein a shear factor between the die and the workpiece during deformation is less than 0.50.

2. The process of claim 1, wherein a shear factor between the die and the workpiece during deformation is less than 0.20.

3. The process of claim 1, wherein a shear factor between the dies and the workpiece during deformation is less than 0.15.

4. The process of claim 1, wherein a shear factor between the die and the workpiece during deformation is in the range of 0.05 to 0.50.

5. The process of claim 1, wherein a shear factor between the die and the workpiece during deformation is in the range of 0.09 to 0.20.

6. The process of claim 1, wherein the solid lubricant sheet is a solid graphite sheet.

7. The process of claim 1, wherein positioning a solid lubricant sheet between a metal or alloy workpiece and the heated die in the forging apparatus comprises:

positioning the solid lubricant sheet onto a surface of the die; and positioning the workpiece onto the solid lubricant sheet.

8. The process of claim 1, wherein positioning a solid lubricant sheet between a metal or alloy workpiece and the heated die in the forging apparatus comprises:

positioning the solid lubricant sheet onto a surface of a lower die; and positioning the workpiece onto the solid lubricant sheet, wherein the solid lubricant sheet is positioned between a bottom surface of the workpiece and a lower die in the forging apparatus.

9. The process of claim 8, further comprising positioning an additional solid lubricant sheet onto a top surface of the workpiece.

10. The process of claim 1, wherein positioning a solid lubricant sheet between a metal or alloy workpiece and the heated die in the forging apparatus comprises:

positioning the solid lubricant sheet on the workpiece before the workpiece is put into the forging apparatus.

11. The process of claim 1, wherein applying force to the workpiece with the die to plastically deform the workpiece occurs while the workpiece is at a temperature in the range of 1000° F. to 2000° F.

12. The process of claim 1, wherein applying force to the workpiece with the die to plastically deform the workpiece occurs while the workpiece is at a temperature in the range of 1000° F. to 1600° F.

13. The process of claim 1, wherein the workpiece is plastically deformed in a forging process selected from the group consisting of open-die forging, closed-die forging, forward extrusion, backward extrusion, radial forging, upset forging, and draw forging.

14. The process of claim 1, wherein the workpiece is plastically deformed in a near-net-shape forging process.

15. The process of claim 1, wherein the workpiece comprises a titanium alloy.

16. The process of claim 1, wherein the workpiece comprises a zirconium alloy.

17. The process of claim 1, further comprising removing residual solid lubricant from the workpiece after the workpiece is plastically deformed.

18. The process of claim 1, wherein the solid lubricant sheet prevents die locking of the workpiece to the die.

19. A forge lubrication process comprising:

heating a die in a forging apparatus;

positioning a solid lubricant sheet, the solid lubricant sheet consisting of a graphite sheet, between a workpiece and the heated die in the forging apparatus, the workpiece comprising titanium, a titanium alloy, zirconium, or a zirconium alloy; and applying force to the workpiece to plastically deform the workpiece with the die in air, wherein the workpiece is at a temperature in the range of 1000° F. to 2000° F. during deformation, and a shear factor between the die and the workpiece during deformation is less than 0.50.

20. The process of claim 19, wherein the workpiece is at a temperature in the range of 1000° F. to 1600° F. during deformation, and the shear factor between the die and the workpiece during deformation is in the range of 0.09 to 0.20.

* * * * *